US008618725B2

(12) United States Patent
Sumoyama et al.

(10) Patent No.: US 8,618,725 B2
(45) Date of Patent: Dec. 31, 2013

(54) SPARK PLUG

(75) Inventors: Daisuke Sumoyama, Nagoya (JP); Tsutomu Shibata, Owariasahi (JP); Tomoo Tanaka, Kitanagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/695,721

(22) PCT Filed: Feb. 3, 2011

(86) PCT No.: PCT/JP2011/000612
§ 371 (c)(1),
(2), (4) Date: Nov. 1, 2012

(87) PCT Pub. No.: WO2011/155101
PCT Pub. Date: Dec. 15, 2011

(65) Prior Publication Data

US 2013/0069516 A1 Mar. 21, 2013

(30) Foreign Application Priority Data

Jun. 11, 2010 (JP) ..... 2010-134045

(51) Int. Cl.
*H01T 13/20* (2006.01)

(52) U.S. Cl.
USPC ..... 313/141; 313/142

(58) Field of Classification Search
USPC ..... 313/141, 142
See application file for complete search history.

(56) References Cited

U.S. PATENT DOCUMENTS

| | | | | |
|---|---|---|---|---|
| 6,798,125 | B2 | 9/2004 | Sugiyama et al. | |
| 2003/0085644 | A1 | 5/2003 | Sugiyama et al. | |
| 2003/0155849 | A1 * | 8/2003 | Hori | 313/141 |
| 2004/0140745 | A1 * | 7/2004 | Hrastnik | 313/141 |
| 2006/0213474 | A1 | 9/2006 | Sugiyama et al. | |
| 2007/0236125 | A1 * | 10/2007 | Lykowski et al. | 313/141 |
| 2010/0264801 | A1 | 10/2010 | Tanaka et al. | |

FOREIGN PATENT DOCUMENTS

| | | | |
|---|---|---|---|
| CN | 1417909 | A | 5/2003 |
| JP | 2004-165165 | A | 6/2004 |

(Continued)

OTHER PUBLICATIONS

International Search Report mailed May 10, 2011 for the corresponding PCT Application No. PCT/JP2011/000612.

(Continued)

*Primary Examiner* — Mary Ellen Bowman
(74) *Attorney, Agent, or Firm* — Leason Ellis LLP.

(57) ABSTRACT

A spark plug includes a ceramic insulator, a center electrode, a metallic shell, and a ground electrode. The center electrode has a shoulder portion at a forward end portion, which tapers forward with respect to the axial direction. A noble metal tip is joined to the forward end portion of the center electrode through a fusion zone. A spark discharge gap is formed between the noble metal tip and the ground electrode. The shortest distance between the fusion zone and a forward end surface of the noble metal tip is 0.8-1.2 mm. The outside diameter of the fusion zone as measured at a forward end of the fusion zone is smaller than that as measured at a rear end of the fusion zone. An acute angle θ1 formed by a straight line L1 and a straight line L2 satisfies the relational expression θ1≤72°.

11 Claims, 11 Drawing Sheets

(56) References Cited

FOREIGN PATENT DOCUMENTS

| | | | |
|---|---|---|---|
| JP | 2005-353606 | A | 12/2005 |
| JP | 2006-173141 | A | 6/2006 |
| JP | 2006-302867 | A | 11/2006 |
| JP | 2010-123626 | A | 6/2010 |
| JP | 2011-171037 | A | 9/2011 |
| WO | WO-2009/081563 | | 7/2009 |

OTHER PUBLICATIONS

Office Action of the corresponding Japanese Application No. 2010-134045 mailed Dec. 2, 2011.
Office Action of the corresponding Japanese Application No. 2010-134045 mailed Feb. 22, 2012.
Office Action issued Aug. 14, 2013 for the corresponding Chinese Application No. 201180028837.1.

* cited by examiner (a)

(b)

SPARK PLUG

CROSS-REFERENCE TO RELATED PATENT APPLICATIONS

This application is a U.S. National Phase Application under 35 U.S.C. §371 of International Patent Application No. PCT/JP2011/000612, filed Feb. 3, 2011, and claims the benefit of Japanese Patent Application No. 2010-134045, filed Jun. 11, 2010, all of which are incorporated by reference herein. The International Application was published in Japanese on Dec. 15, 2011 as International Publication No. WO/2011/155101 under PCT Article 21(2).

FIELD OF THE INVENTION

The present invention relates to a spark plug, and more particularly to a spark plug in which a noble metal tip is provided on at least one of a center electrode and a ground electrode.

BACKGROUND OF THE INVENTION

A spark plug used for ignition in an internal combustion engine (e.g., an automobile engine) generally includes a tubular metallic shell; a tubular insulator provided in an inner hole of the metallic shell; a center electrode provided in an inner hole of the insulator on the front end side thereof; and a ground electrode, one end of which is bonded to the front end of the metallic shell and the other end of which forms a gap with the center electrode. There has also been known a spark plug in which a tip formed of a noble metal alloy is provided on an end surface of a center electrode or a ground electrode for the purpose of, for example, improving spark erosion resistance.

Recent internal combustion engines for automobiles, etc. have been required to exhibit high output and high ignition performance. In connection with such a requirement, there have been developed an internal combustion engine having a supercharger in which high pressure is achieved in a combustion chamber, and an internal combustion engine employing a high-energy coil. Since a spark plug of such an internal combustion engine is used under severe environmental conditions, demand has arisen for development of a spark plug exhibiting excellent spark erosion resistance and separation resistance, as well as oxidation resistance.

For example, Japanese Patent Application Laid-Open (kokai) No. 2005-353606 discloses a spark plug including a noble metal tip which is formed of a material containing Pt and Rh, Ir, Ni, Pd, or the like, and which exhibits improved erosion resistance. Meanwhile, Japanese Patent Application Laid-Open (kokai) No. 2004-165165 discloses a spark plug characterized by including an electrode having an electrode segment located at one end segment of the electrode, the electrode segment including an alloy containing copper, which spark plug can be produced at low cost, wherein only minimal thermomechanical stresses occur between the electrode segment and an electrode base body.

In addition, there have been disclosed many spark plugs in which a tip formed of a noble metal alloy is provided on a center electrode and/or a ground electrode.

Problems to be Solved by the Invention

However, hitherto known tips formed of noble metal alloys have both advantages and disadvantages, and a spark plug satisfying all performance criteria has not yet been provided.

For example, a noble metal tip formed of a Pt—Rh alloy or a Pt—Ir alloy exhibits particularly good spark erosion resistance, but the noble metal tip exhibits poor breakage resistance and poor resistance against separation of the tip from an electrode matrix when used in a combustion chamber (i.e., under high-temperature environmental conditions and cooling cycle conditions). Meanwhile, a noble metal tip formed of a Pt—Ni alloy exhibits particularly good separation resistance, but poor spark erosion resistance.

In order to solve the aforementioned problems, an object of the present invention is to provide a spark plug including a noble metal tip exhibiting intended durability. Specifically, an object of the present invention is to provide a spark plug including a noble metal tip exhibiting excellent erosion resistance, separation resistance, and breakage resistance.

SUMMARY OF THE INVENTION

Means for Solving the Problems

Means for solving the aforementioned problems is (I) a spark plug comprising a center electrode; a ground electrode provided so as to form a gap between the ground electrode and the center electrode; and a noble metal tip provided on at least one of the center electrode and the ground electrode, characterized in that the noble metal tip contains Mp (Mp is an element group consisting of Pt or Pt and Pd, and the amount of Pd is 20 mass % or less with respect to the mass of the noble metal tip), Cu, and M (M is at least one element selected from the element group consisting of Rh, Ir, Ru, Re, and W) in a total amount of 95 mass % or more; and the proportions by mass of Mp, Cu, and M (Mp, Cu, M) in a Mp-Cu-M ternary composition diagram fall within a region defined by a line connecting point D (95, 5, 0), point E (94.5, 5, 0.5), point F (87, 5, 8), point G (80, 12, 8), point H (79.5, 20, 0.5), point I (80, 20, 0), and point D (95, 5, 0) in this order (the region including the line).

A preferred mode of (I) above is characterized in that (II) the proportions by mass (Mp, Cu, M) in the noble metal tip in the Mp-Cu-M ternary composition diagram fall within a region defined by a line connecting point E (94.5, 5, 0.5), point F (87, 5, 8), point G (80, 12, 8), point H (79.5, 20, 0.5), and point E (94.5, 5, 0.5) in this order (the region including the line); or characterized by (III) a spark plug comprising an insulator having an axial hole; a center electrode provided in the axial hole; a ground electrode provided so as to form a gap between the ground electrode and the center electrode; and a noble metal tip provided on at least one of the center electrode and the ground electrode, wherein welding area S ($mm^2$), tip protrusion height H (mm), covering length L (mm), and the distance between the tip and a welded portion (hereinafter may be referred to as "tip-welded portion distance") h (mm) satisfy the following relations: (a) $H \leq 0.13S+1.18$, (b) $S \leq 5$, and (c) $0.1 \leq h$ or $0.03 \leq L$, wherein welding area S is defined as being the area of a region in which, when the noble metal tip is provided on an end surface or a peripheral side surface of the center electrode and/or the ground electrode, as viewed in a direction X—which is a direction perpendicular to a bonding surface of a mounting metallic body (the body corresponding to the center electrode, the ground electrode, or a base provided between each of these electrodes and the noble metal tip) to which the noble metal tip is bonded via a welded portion formed through fusion between the noble metal tip and the mounting metallic body, a projection region formed by projection of the mounting metallic body on a surface perpendicular to the direction X overlaps a projection region formed by projection of the noble metal tip on a surface perpendicular to the direction X (when the noble metal tip is bonded to the mounting metallic body via a plurality of surfaces of the mounting metallic body, welding area S is defined as being the total area of regions in which, as viewed in directions Y—which are perpendicular to the surfaces, the surfaces overlap one another);

tip protrusion height H is defined as being the distance between the bonding surface of the mounting metallic body and the end surface of the noble metal tip most distal from the bonding surface, the distance being determined in a direction in which the noble metal tip faces a facing metallic protrusion (the protrusion corresponding to the noble metal tip, a portion protruded from the front end of the center electrode, or portion protruded from the distal end of the ground electrode) (when the welded portion is provided between the noble metal tip and the mounting metallic body so as to cover the entire top surface of the mounting metallic body, tip protrusion height H is defined as being the distance between a point corresponding to ½ the thickness of the thinnest portion of the welded portion in a direction of an axis PX of the noble metal tip, and the surface of the noble metal tip most distal from the point in the direction of the axis PX); and covering length L and tip-welded portion distance h are defined as follows: in the case where the axial hole extends in a direction of an axis AX of the center electrode, (1) when the noble metal tip and the facing metallic protrusion are arranged so as to face each other in the direction of the axis AX, and the noble metal tip does not project from the mounting metallic body in a direction perpendicular to the axis AX, covering length L is defined as being the minimum distance, as viewed in the direction of the axis AX, between a straight line group which includes a point k1 on a peripheral side surface corresponding to the maximum diameter of the noble metal tip and which is parallel to the axis AX, and a straight line group which includes a point k2 on a peripheral side surface corresponding to the maximum diameter of the facing metallic protrusion and which is parallel to the axis AX; and tip-welded portion distance h is defined as being the distance in the direction of the axis AX as measured, on a surface of the noble metal tip which includes the point k1 and is parallel to the axis AX, from the end of the noble metal tip to the boundary between the tip and the welded portion; or (2) when the noble metal tip projects from the ground electrode in a direction perpendicular to the axis AX, and the front end surface of the facing metallic protrusion faces the noble metal tip in the direction of the axis AX, covering length L is defined as being the minimum distance, as viewed in the direction of the axis AX, between a point k3 on a projection region formed by projection of the front end surface of the facing metallic protrusion on a virtual surface perpendicular to the direction of the axis AX, and an intersection point k4 provided by intersection of the contour of a projection region formed by projection of the ground electrode on the virtual surface with the contour of a projection region formed by projection of the noble metal tip on the virtual surface; and (i) in the noble metal tip, tip-welded portion distance h is defined as being the distance as measured, on a surface of the noble metal tip which includes the point k4 and is parallel to the axis AX, from the end of the noble metal tip to the boundary between the tip and the welded portion; or (ii) when the facing metallic protrusion is the noble metal tip provided on the center electrode, tip-welded portion distance h is defined as being the distance in the direction of the axis AX as measured, on a surface of the noble metal tip which includes the point k3 and is parallel to the axis AX, from the end of the noble metal tip to the boundary between the tip and the welded portion.

Another means for solving the aforementioned problems is (IV) a spark plug comprising an insulator having an axial hole; a center electrode provided in the axial hole; a ground electrode provided so as to form a gap between the ground electrode and the center electrode; and a noble metal tip provided on at least one of the center electrode and the ground electrode, characterized in that the noble metal tip contains Mp (Mp is an element group consisting of Pt or Pt and Pd, and the amount of Pd is 20 mass % or less with respect to the mass of the noble metal tip), Cu, and M (M is at least one element selected from the element group consisting of Rh, Ir, Ru, Re, and W) in a total amount of 95 mass % or more; the proportions by mass of Mp, Cu, and M (Mp, Cu, M) fall within a region defined by a line connecting point A (97, 3, 0), point B (80, 3, 17), point C (75, 25, 0), and point A (97, 3, 0) in this order (the region including the line); and welding area S ($mm^2$), tip protrusion height H (mm), covering length L (mm), and tip-welded portion distance h (mm), which are defined above in (III), satisfy the following relations: (a) $H \leq 0.13S+1.18$, (b) $S \leq 5$, and (c) $0.1 \leq h$ or $0.03 \leq L$.

A preferred mode of (I) or (IV) above is characterized in that (V) Mp is Pt and Pd; (VI) the noble metal tip contains at least one element selected from the element group A consisting of Ni, Co, Fe, and Mn, and/or the element group B consisting of Ti, Hf, Y, and rare earth elements, the total mass of the element group A is 5 mass % or less, the total mass of the element group B is 1.5 mass % or less, and the total mass of the element group A and the element group B is 5 mass % or less; (VII) M is Rh; (VIII) the noble metal tip has a hardness of 140 Hv or more; (VIIII) the noble metal tip has a hardness of 200 Hv or more; (X) the center electrode is fixed in the axial hole of the insulator so as to be exposed through one end of the axial hole, a terminal shell is fixed in the axial hole so as to be exposed through the other end of the axial hole, a resistor is provided between the center electrode and the terminal shell in the axial hole, and the resistor has a resistance of 10 kΩ or less; or (XI) the noble metal tip is provided only on the ground electrode.

Effects of the Invention

According to the spark plug described above in (I), the noble metal tip provided on at least one of the center electrode and the ground electrode contains Mp, Cu, and M in a total amount of 95 mass % or more, and the proportions by mass of Mp, Cu, and M fall within specific ranges. Therefore, the noble metal tip of the spark plug exhibits excellent durability; in particular, excellent erosion resistance, separation resistance, and breakage resistance.

According to the spark plug described above in (IV), the noble metal tip provided on at least one of the center electrode and the ground electrode contains Mp, Cu, and M in a total amount of 95 mass % or more; the proportions by mass of Mp, Cu, and M fall within specific ranges; and the noble metal tip has specific dimensions. Therefore, the noble metal tip of the spark plug exhibits excellent durability; in particular, excellent erosion resistance, separation resistance, and breakage resistance.

When the noble metal tip further contains at least one element selected from the element group A consisting of Ni, Co, Fe, and Mn, and/or the element group B consisting of Ti, Hf, Y, and rare earth elements in a specific amount, the spark plug is further excellent in terms of at least one of separation resistance and tip breakage resistance.

When the hardness of the noble metal tip is equal to or higher than a specific level, the noble metal tip exhibits further excellent impact resistance. Thus, even when the noble metal tip comes into contact with and is impacted by a jig during a production process, deformation of the noble metal tip can be suppressed.

Even when the resistor of the spark plug has a resistance of 10 kΩ or less, and high energy is applied to a spark discharge gap during spark discharge, since the noble metal tip exhibits excellent erosion resistance, etc., the spark plug can maintain its performance.

In addition, when the noble metal tip is provided on the ground electrode, which is exposed to high temperature and severe environmental conditions, as compared with the case of the center electrode, more effective performance is achieved.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 1(*a*) is a partially cross-sectional view of the entirety of one embodiment of the spark plug of the present invention; and FIG. 1(*b*) is a cross-sectional view of a main portion of one embodiment of the spark plug of the present invention.

FIG. 4(*b*) shows a main portion of a ground electrode as viewed in a direction X shown in FIG. 4(*a*).

FIG. 5(*b*) shows a main portion of a ground electrode as viewed in a direction X2 shown in FIG. 5(*a*).

FIG. 6(*b*) shows a main portion of a ground electrode as viewed in a direction X3 shown in FIG. 6(*a*).

FIG. 7(*b*) shows a main portion of a ground electrode as viewed in a direction X4 shown in FIG. 7(*a*).

FIG. 8(*b*1) shows a main portion of a ground electrode as viewed in a direction Y1 shown in FIG. 8(*a*).

FIG. 8(*b*2) shows the main portion of the ground electrode as viewed in a direction Y2 shown in FIG. 8(*a*).

FIG. 8(*b*3) shows the main portion of the ground electrode as viewed in a direction Y3 shown in FIG. 8(*a*).

FIG. 9(*b*) shows a main portion of a ground electrode as viewed in a direction X6 shown in FIG. 9(*a*). FIG. 9(*c*) is a representation illustrating a tip cross-sectional area A of a ground electrode tip.

DETAILED DESCRIPTION OF THE INVENTION

Modes for Carrying Out the Invention (First Invention)

The spark plug of the first invention includes a center electrode and a ground electrode, wherein one end of the center electrode faces one end of the ground electrode via a gap, and a noble metal tip is provided on at least one of the center electrode and the ground electrode. No particular limitation is imposed on the configuration of a portion other than a main portion of the spark plug of the first invention, so long as the main portion of the spark plug has the aforementioned configuration. That is, the portion other than the main portion may have any known configuration.

Figure 1:
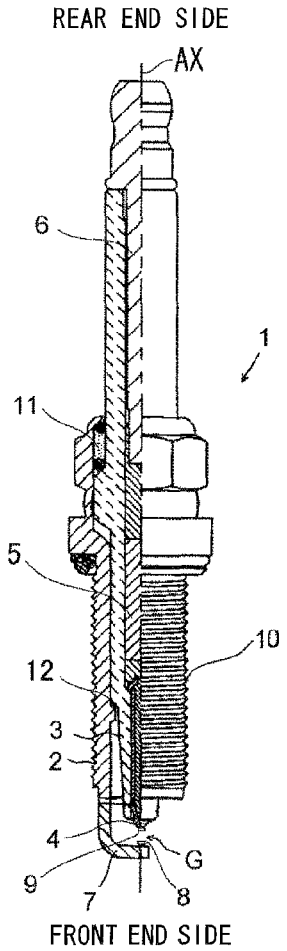
FIG. 1 is one embodiment of the spark plug of the present invention.
Figure 1:
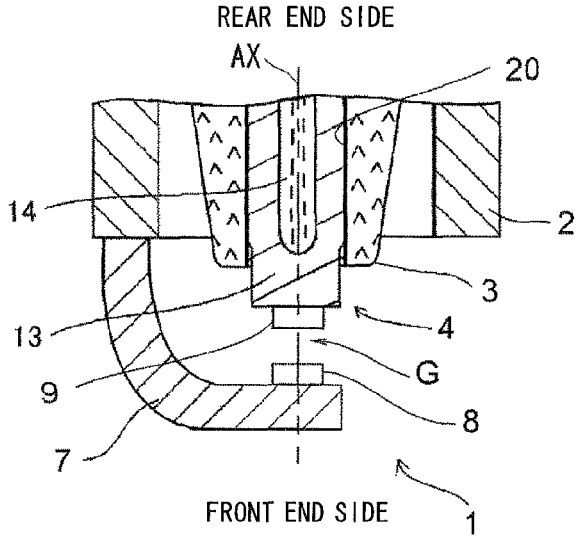

FIG. 1 shows one embodiment of the spark plug of the first invention. FIG. 1(*a*) is a partially cross-sectional view of the entirety of a spark plug 1, which is one embodiment of the spark plug of the first invention; and FIG. 1(*b*) is a cross-sectional view of a main portion of the spark plug 1, which is one embodiment of the spark plug of the first invention. The axis of the center electrode is represented by "AX." In the following description, the lower side of FIG. 1(*a*) or 1(*b*) is referred to as the front end side of the axis AX, and the upper side of FIG. 1(*a*) or 1(*b*) is referred to as the rear end side of the axis AX.

As shown in FIGS. 1(*a*) and 1(*b*), the spark plug 1 includes a circular columnar metallic shell 2; an insulator 3 which has a generally circular columnar shape and is provided inside the metallic shell 2; a center electrode 4, resistor 5, and a terminal shell 6, which are provided inside an axial hole 20 of the insulator 3 so as to be sequentially arranged from the front end side; and a ground electrode 7, one end of which faces the front end surface of the center electrode 4 via a gap, and the other end of which is bonded to the frond end surface of the metallic shell 2. A noble metal tip is provided on the distal end surface of the ground electrode 7 facing the center electrode (hereinafter the noble metal tip provided on the ground electrode may be referred to as "ground electrode tip 8"), and a noble metal tip is provided on the front end surface of the center electrode 4 (hereinafter the noble metal tip provided on the center electrode may be referred to as "center electrode tip 9"). A spark discharge gap G is provided between the ground electrode tip 8 and the center electrode tip 9.

The metallic shell 2 has a generally circular columnar shape, and is formed so as to hold the insulator 3 provided therein. The metallic shell 2 has a threaded portion 10 on an outer peripheral surface on the front end side. By means of the threaded portion 10, the spark plug 1 is attached to a non-illustrated cylinder head of an internal combustion engine. The metallic shell 2 may be formed of an electrically conductive steel material such as low-carbon steel.

The insulator 3 is held by the inner wall of the metallic shell 2 via, for example, talc 11 or packing 12, and the center electrode 4, the resistor 5, and the terminal shell 6 are held in the axial hole 20 of the insulator 3. The insulator 3 is fixed to the metallic shell 2 such that the front end portion of the insulator 3 projects from the front end surface of the insulator 2. The insulator 3 is preferably formed of a material exhibiting, for example, mechanical strength, thermal strength, and electrical strength. Examples of such a material include a sintered ceramic material mainly containing alumina.

The center electrode 4 is formed of an outer member 13, and an inner member 14 which is concentrically buried in an axial core portion of the outer member 13. The center electrode 4 is fixed in the axial hole 20 of the insulator 3 such that the front end portion of the electrode 4 projects from the front end surface of the insulator 3, and the center electrode 4 is insulated from the metallic shell 2. The outer member 13 is preferably formed of a material exhibiting, for example, thermal conductivity and mechanical strength, such as an Ni-based alloy (e.g., Inconel (trade name)). The inner member 14 may be formed of a metal material exhibiting excellent thermal conductivity, such as Cu or Ag.

The shape and structure of the ground electrode 7 are designed such that, for example, the electrode 7 has a generally rectangular columnar shape; one end of the electrode 7 is bonded to the front end surface of the metallic shell 2; the electrode 7 is bent in a generally L-shape at a middle portion thereof; and the distal end portion of the electrode 7 is located on the front end side of the axis AX of the center electrode 4. With this design, one end of the ground electrode 7 faces the center electrode 4 via a gap. The ground electrode 7 is formed of a material similar to that forms the center electrode 4.

The terminal shell 6 is fixed in the axial hole 20 of the insulator 3 such that the rear end portion of the shell 6 projects from the rear end surface of the insulator 3, and the terminal shell 6 is insulated from the metallic shell 2. The terminal shell 6 is formed of, for example, low-carbon steel, and an Ni metal layer is formed on the surface of the shell 6 through plating or a similar technique.

The resistor 5 is fixed between the center electrode 4 and the terminal shell 6 in the axial hole 20 of the insulator 3. The resistor 5 may be formed of glass powder, ceramic powder, non-metallic electrically conductive powder, and/or a mixture of metal powder, etc. The resistor 5 generally has a resistance of 15 kΩ or less. When the resistance is 10 kΩ or less, particularly, the energy applied to the spark discharge gap G increases during spark discharge, and thus spark erosion occurs considerably. Therefore, when the resistor 5 has a resistance of 10 kΩ or less, the noble metal tip formed of the below-described tip material further exhibits its effects.

The ground electrode tip 8 has, for example, a circular columnar shape, and is provided at the distal end portion of the ground electrode 7 such that the tip 8 faces the center electrode tip 9 provided on the front end surface of the center electrode 4. The ground electrode tip 8 may be formed of the below-described tip material, or any known material other than the tip material. However, the ground electrode tip 8 is preferably formed of the below-described tip material, since the ground electrode tip 8 is generally exposed to a higher temperature, as compared with the center electrode tip 9.

The center electrode tip 9 has, for example, a circular columnar shape, and is provided on the front end surface of the center electrode 4. The center electrode tip 9 is formed of the below-described tip material, or any known material other than the tip material.

The ground electrode tip 8 and the center electrode tip 9 are provided so as to face each other via the gap (i.e., the spark discharge gap G). In the spark plug 1 of the first invention, the noble metal chip 8 or 9 may be provided on at least one of the center electrode 4 and the ground electrode 7. When, for example, the noble metal tip 8 is provided only on the ground electrode 7, the spark discharge gap corresponds to a gap between the center electrode 4 and the ground electrode tip 8. The spark discharge gap is generally adjusted to 0.3 to 1.5 mm.

In the spark plug 1, at least one of the ground electrode tip 8 and the center electrode tip 9 is formed of the below-described tip material. Preferably, the ground electrode tip 8, which is heated to a higher temperature, is formed of the below-described tip material.

Figure 2:
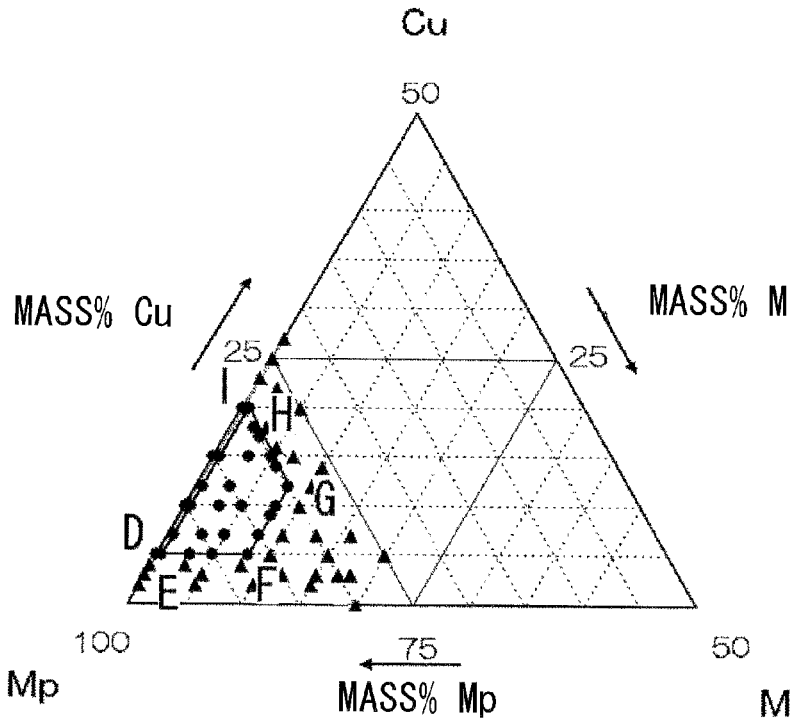
FIG. 2 is a ternary composition diagram showing the proportions by mass of Mp, Cu, and M contained in a noble metal tip provided in the spark plug of the present invention.

The tip material forming each of these noble metal tips contains Mp (Mp is an element group consisting of Pt or Pt and Pd, and the amount of Pd is 20 mass % or less with respect to the mass of the noble metal tip), Cu, and M (M is at least one element selected from the element group consisting of Rh, Ir, Ru, Re, and W) in a total amount of 95 mass % or more, wherein the proportions by mass of Mp, Cu, and M (Mp, Cu, M) in the Mp-Cu-M ternary composition diagram shown in FIG. 2 fall within a region defined by a line connecting point D (95, 5, 0), point E (94.5, 5, 0.5), point F (87, 5, 8), point G (80, 12, 8), point H (79.5, 20, 0.5), point I (80, 20, 0), and point D (95, 5, 0) in this order (the region including the line).

When the tip material contains Mp, Cu, and M in an amount of 95 mass % or more, and, the proportions by mass of the three components (Mp, Cu, M) in the Mp-Cu-M ternary composition diagram fall within a region defined by a line connecting points D, E, F, G, H, I, and D in this order (the region includes the line), the noble metal tip of the spark plug exhibits excellent erosion resistance, separation resistance, and breakage resistance.

In the aforementioned tip material, preferably, the proportions by mass of the three components (Mp, Cu, M) in the ternary composition diagram fall within a region defined by a line connecting point E (94.5, 5, 0.5), point F (87, 5, 8), point G (80, 12, 8), point H (79.5, 20, 0.5), and point E (94.5, 5, 0.5) in this order (the region includes the line).

When the amount of Cu is 5 mass % or more in the ternary composition diagram, the tip material exhibits excellent separation resistance, as compared with the case of a Pt—Rh alloy or a Pt—Ir alloy, since the difference in thermal expansion coefficient decreases between the tip material and an Ni-based alloy employed as a material for forming the center electrode or the ground electrode. Since the tip material can suppress lowering of melting point, as compared with a Pt—Ni alloy, which is known as a material for effectively improving separation resistance, the tip material exhibits excellent spark erosion resistance, as well as excellent separation resistance. In addition, in the tip material, crystal grain size is less likely to increase, as compared with the case of a Pt—Rh alloy, in which crystal grain size tends to increase. Since internal oxidation is suppressed in the tip material, as compared with the case of a Pt—Ir alloy, the tip material exhibits excellent breakage resistance.

When the amount of Cu is less than 5 mass % in the ternary composition diagram, the aforementioned effects may fail to be attained. When the amount of Cu exceeds 25 mass % in the ternary composition diagram; i.e., when the amount of Cu, which is easily oxidized, increases, oxidation resistance may be lowered, and internal oxidation may occur in crystal grain boundaries, resulting in breakage or separation of the tip. In addition, such a problem may cause impairment of thermal conductivity, which may adversely affect erosion resistance.

When the tip material contains M (particularly when the amount of M is 0.5 mass % or more in the ternary composition diagram), the tip material exhibits excellent spark erosion resistance, since M has a high melting point. Also, since crystal grain size decreases, falling of crystal grains, which is caused by breakage in the tip, can be suppressed. In addition, since the tip material exhibits high strength, even when it comes into contact with and is impacted by a jig during a production process, deformation of the noble metal tip can be suppressed. Thus, the tip material exhibits excellent impact resistance.

However, when the amount of M exceeds 8 mass % in the ternary composition diagram, embrittlement may occur, and thus proccessability is impaired, and breakage of the tip, which is caused by thermal stress or internal corrosion, is likely to occur. Since M has a low thermal expansion coefficient, when a large amount of M is incorporated, the difference in thermal expansion coefficient increases between the tip material and an Ni-based alloy employed as an electrode material, which adversely affects separation resistance. Therefore, the amount of M is 8 mass % or less in the ternary composition diagram.

The effects of Cu and M in the tip material have been described above. Needless to say, the tip material is greatly affected not only by the proportion by mass of a single component, but also by the proportions by mass of three components (Mp, Cu, M). When the total amount of Cu and M contained in the tip material is equal to or greater than a specific level; i.e., when the proportions by mass of Cu and M exceed levels corresponding to line GH in the ternary composition diagram, at least one of separation resistance, erosion resistance, and tip breakage resistance is deteriorated. Therefore, the proportions by mass of Cu and M are equal to or lower than levels corresponding to line GH in the ternary composition diagram.

M is at least one element selected from the element group consisting of Rh, Ir, Ru, Re, and W. Each of Rh, Ir, Ru, Re, and W has a high melting point, and is difficult to sputter. When Pt is employed in combination with each of these elements, strength is improved, and crystal grain size can be reduced. Therefore, when the amount of at least one element selected from the element group falls within a region shown in the ternary composition diagram, the noble metal tip of the spark plug exhibits excellent separation resistance, erosion resistance, and breakage resistance. Among the elements of this group, Rh is particularly preferred, since Rh itself is oxidized to form a dense oxide film, whereby further oxidation thereof can be suppressed.

Mp is an element group consisting of Pt or Pt and Pd, and the amount of Pd is 20 mass % or less with respect to the mass of the noble metal tip. Pt is preferably employed as a main component of the tip material, since it exhibits excellent oxidation resistance, spark erosion resistance, and proccessability. Incorporation of a specific amount of Pd is advantageous in terms of separation resistance, since Pd exhibits excellent oxidation resistance similar to the case of Pt, and has a thermal expansion coefficient greater than that of Pt. Therefore, when the amount of Pd is 20 mass % or less with respect to the entire mass of the noble metal tip formed of the tip material, the noble metal tip of the spark plug exhibits further excellent separation resistance. However, when the amount of Pd exceeds 20 mass %, the melting point of the tip material is lowered, resulting in impairment of erosion resistance.

Preferably, the tip material contains at least one element selected from the element group A consisting of Ni, Co, Fe, and Mn, and/or the element group B consisting of Ti, Hf, Y, and rare earth elements; the total mass of the element group A is 5 mass % or less with respect to the entire mass of the noble metal tip formed of the tip material; the total mass of the element group B is 1.5 mass % or less with respect to the entire mass of the noble metal tip formed of the tip material; and the total mass of the element group A and the element group B is less than 5 mass % with respect to the entire mass of the noble metal tip formed of the tip material.

When the total mass of the element group A is more than 0 mass % and 5 mass % or less in the tip material, the tip material exhibits further excellent separation resistance and breakage resistance. Since the element group A has a high thermal expansion coefficient, the difference in thermal expansion coefficient decreases between the tip material and an electrode material, and generation of thermal stress can be suppressed. In addition, since crystal grain size is reduced, the breakage resistance of the tip material is effectively improved.

When the total mass of the element group B is more than 0 mass % and 1.5 mass % or less (particularly 0.01 mass % to 1 mass %) in the tip material, since crystal grain size is reduced, the tip material exhibits excellent breakage resistance.

When the amount of the element group A or the element group B is excessively large in the tip material, the melting point of the tip material may be lowered, resulting in poor erosion resistance. Therefore, the total mass of the element group A and the element group B is preferably 5 mass % or less with respect to the mass of the noble metal tip.

The tip material contains Mp, Cu, and M in a total amount of 95 mass % or more, and substantially contains the element group A consisting of Ni, Co, Fe, and Mn, and the element group B consisting of Ti, Hf, Y, and rare earth elements, as desired. The tip material contains these components such that the amounts of the components fall within the aforementioned ranges, and the total amount of these components and an inevitable impurity is 100 mass %. The tip material may contain a very small amount of a component other than the aforementioned components; i.e., an inevitable impurity such as Ag, B, Ca, Al, Si, or Mg. Preferably, the amount of such an inevitable impurity is reduced to a minimum possible level. However, the tip material may contain such an impurity, so long as the object of the present invention can be achieved. Preferably, the amount of any one of the aforementioned inevitable impurities is 0.1 parts by mass or less, and the total amount of all the inevitable impurities contained in the tip material is 0.2 parts by mass or less, on the basis of 100 parts by mass of the total mass of the aforementioned components.

The amount of each component contained in the noble metal tip formed of the aforementioned tip material may be determined as follows. Specifically, the noble metal chip 8 or 9 is subjected to cutting, and a cross section thereof is exposed. By means of EPMA, WDS (wavelength dispersive X-ray spectrometer) analysis is performed on a plurality of points (e.g., five points) of the cross section of the noble metal tip 8 or 9, to thereby determine the mass composition of each point. Subsequently, the values as determined at the points are averaged, and the thus-obtained average value is regarded as the composition of the noble metal tip. Notably, measurement is not carried out on a welded portion 15, which is formed when the noble metal tip 8 or 9 is fusion-bonded to the center electrode 4, the ground electrode 7, and/or a mounting metallic body (e.g., a base).

The tip material is produced through the below-described method by mixing specific raw materials in specific proportions. The composition of the thus-produced tip material generally corresponds to that of the raw materials. Therefore, the amount of each component contained in the tip material may be conveniently calculated on the basis of the proportions of the raw materials incorporated.

The noble metal tip formed of the aforementioned tip material preferably has a hardness of 140 Hv or more, particularly preferably 200 Hv or more.

In the case where the hardness of the noble metal tip falls within the above range, even when the tip comes into contact with a jig during a production process, deformation of the noble metal tip can be prevented.

Figure 3:
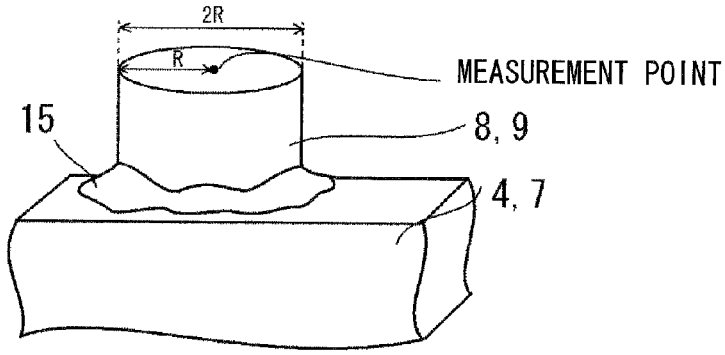
FIG. 3*shows* a position at which the hardness of a noble metal tip of a spark plug is measured.

The hardness of the noble metal tip is measured as follows. As shown in FIG. 3, the micro-Vickers hardness of the noble metal tip 8 or 9 is measured according to JIS Z 2244 by means of a micro-Vickers hardness meter (load: 1 N) at the center of the surface opposite the surface bonded to the center electrode 4 or the ground electrode 7.

The hardness of the noble metal tip may be adjusted by varying, for example, the composition of the tip material, the processing conditions for producing the noble metal tip, the thermal treatment temperature and time before and after this processing, the thermal load during welding of the noble metal tip to the ground electrode or the center electrode, the amount of deformation of the noble metal tip (in the case of resistance welding), or the thermal treatment conditions for bonding of the resistor, the insulator, the metallic terminal, and the center electrode (in the case where the noble metal tip is provided on the center electrode). Specifically, processing strain is increased by increasing the percent processing during production of the noble metal tip, lowering the thermal treatment temperature or shortening the thermal treatment time after processing, lowering the temperature for welding of the noble metal tip to the ground electrode or the center electrode or shortening the welding time, and/or increasing the amount of deformation of the noble metal tip (in the case of resistance welding), whereby high deformation resistance is achieved, resulting in high hardness.

When the noble metal tip of the spark plug of the first invention, which is formed of the aforementioned tip material, has the below-described dimensions, the noble metal tip of the spark plug exhibits further excellent erosion resistance, breakage resistance, and separation resistance.

Preferably, the below-defined welding area S ($mm^2$), tip protrusion height H (mm), covering length L (mm), and tip-welded portion distance h (mm) satisfy the following relations: (a) $H \leq 0.13S+1.18$, (b) $S \leq 5$, and (c) $0.1 \leq h$ or $0.03 \leq L$.

In the noble metal tip, preferably, the below-defined tip cross-sectional area A ($mm^2$) satisfies the following relation: (d) $0.2 \leq A \leq 1.8$.

When, in the noble metal tip, welding area S and tip protrusion height H satisfy the following relation: (a) $H \leq 0.13S+1.18$, the noble metal tip of the spark plug exhibits further excellent erosion resistance. In order to improve the erosion resistance of the noble metal tip, preferably, the heat dissipation of the noble metal tip is increased. Hitherto, it has been considered that when welding area S is small, the contact area between the noble metal tip and the electrode is reduced, and thus heat received by the noble metal tip is less likely to be transferred to the electrode, resulting in poor heat dissipation. However, the present inventors have found that heat dissipation is affected not only by welding area S, but also by tip protrusion height H. That is, even in the case where welding area S is small, when tip protrusion height H is smaller than a specific value, overheating of the noble metal tip can be suppressed, and favorable erosion resistance is achieved. Conversely, even in the case where tip protrusion height H is large, when welding area S is large, favorable heat dissipation is achieved, and thus overheating of the noble metal tip can be suppressed.

When, in the noble metal tip, welding area S, covering length L, and tip-welded portion distance h satisfy the following relations: (b) $S \leq 5$ and (c) $0.1 \leq h$ or $0.03 \leq L$, the noble metal tip of the spark plug exhibits further excellent separation resistance. When welding area S is large, high thermal stress is generated particularly in an outer peripheral portion of the noble metal tip due to the difference in thermal expansion coefficient between the tip material forming the noble metal tip and the material forming the electrode, and thus the noble metal tip is likely to be detached from the electrode. Therefore, welding area S is preferably 5 or less. Since highly turbulent airflow occurs in a combustion chamber, when covering length L and tip-welded portion distance h fall outside the above ranges, discharge is likely to occur at a portion of the electrode in the vicinity of the outer periphery of the noble metal tip and/or at the welded portion. Since the electrode or the welded portion has a melting point lower than that of the noble metal tip, the electrode or the welded portion is easily eroded, and the boundary between the noble metal tip and the electrode or the welded portion is hollowed, resulting in poor separation resistance. In addition, when the electrode or the welded portion is eroded, welding area S is substantially reduced, which adversely affects erosion resistance. Therefore, tip-welded portion distance h is preferably 0.1 or more, or covering length L is preferably 0.03 or more.

In the noble metal tip, tip cross-sectional area A preferably satisfies the following relation: (d) $0.2 \leq A \leq 1.8$. When tip cross-sectional are A falls within the above range, further excellent erosion resistance is achieved.

Figure 4:
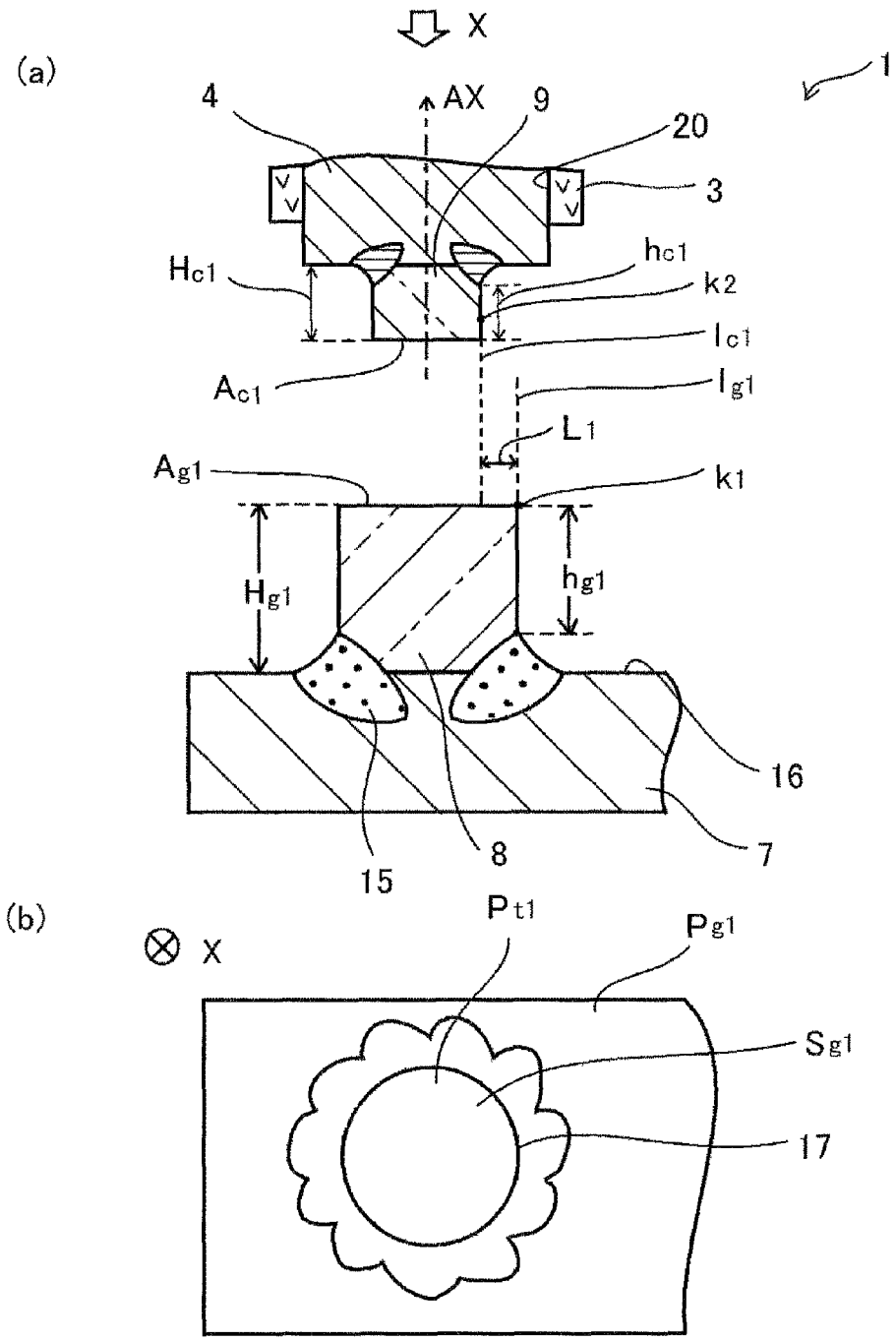
FIG. 4(*a*) is a cross-sectional view of an ignition portion of one embodiment of the spark plug of the present invention.

FIG. 4(*a*) is a cross-sectional view of an ignition portion of one embodiment of the spark plug of the first invention. FIG. 4(*b*) shows a main portion of a ground electrode as viewed in a direction X shown in FIG. 4(*a*). When the welding area of the ground electrode tip 8 of the spark plug 1 of this embodiment is represented by $S_{g1}$, as shown in FIG. 4(*b*), the welding area $S_{g1}$ is the area of a region in which, as viewed in the direction X—which is a direction perpendicular to a bonding surface 16 of the ground electrode to which the ground electrode tip 8 is bonded via the welded portion 15 formed through fusion between the bonding electrode tip 8 and the ground electrode 7 (which may be referred to as "mounting metallic body"), a projection region $P_{g1}$ formed by projection of the ground electrode 7 on a surface perpendicular to the direction X overlaps a projection region $P_{t1}$ formed by projection of the ground electrode tip 8 on a surface perpendicular to the direction X. Also, the welding area $S_{c1}$ of the center electrode tip 9 is defined in a manner similar to that of the welding area $S_{g1}$ of the ground electrode tip 8.

The welding area $S_{g1}$ is determined as follows. Specifically, the ground electrode 7 is photographed from above in the direction X, and the area of a region defined by a boundary line 17 between the ground electrode tip 8 and the welded portion 15 is calculated by means of image analysis software (e.g., Photoshop). Also, the welding area $S_{c1}$ may be determined in a manner similar to that described above.

When the tip protrusion height of the ground electrode tip 8 of the spark plug 1 of this embodiment is represented by $H_{g1}$, the tip protrusion height $H_{g1}$ is the distance between the bonding surface 16 of the ground electrode 7 and the end surface of the ground electrode tip 8 most distal from the bonding surface 16, the distance being determined in a direction in which the ground electrode tip 8 faces the center electrode tip 9 (which may be referred to as "facing metallic protrusion"). Also, the tip protrusion height $H_{c1}$ of the center electrode tip 9 is defined in a manner similar to that of the tip protrusion height $H_{g1}$ of the ground electrode tip 8.

When the covering length in the spark plug 1 of this embodiment is represented by $L_1$, the covering length $L_1$ is defined as described below, since the axial hole 20 of the insulator 3 extends in the direction of the axis AX of the center electrode 4; the ground electrode tip 8 and the center electrode tip 9 are arranged so as to face each other in the direction of the axis AX; and the ground electrode tip 8 does not project from the ground electrode 7 in a direction perpendicular to the axis AX. Specifically, the covering length $L_1$ is the minimum distance, as viewed in the direction of the axis AX, between a straight line group $I_{g1}$ which includes a point k1 on a peripheral side surface corresponding to the maximum diameter of the ground electrode tip 8 and which is parallel to the axis AX, and a straight line group $I_{c1}$ which includes a point k2 on a peripheral side surface corresponding to the maximum diameter of the center electrode tip 9 and which is parallel to the axis AX.

When the tip-welded portion distance of the ground electrode tip 8 of the spark plug 1 of this embodiment is represented by $h_{g1}$, the tip-welded portion distance $h_{g1}$ is the distance in the direction of the axis AX as measured, on a surface of the ground electrode tip 8 which includes the point k1 and is parallel to the axis AX, from the end of the ground electrode tip 8 to the boundary between the tip 8 and the welded portion 15. Also, the tip-welded portion distance $h_{c1}$ of the center electrode tip 9 is defined in a manner similar to that of the tip-welded portion distance $h_{g1}$ of the ground electrode tip 8.

When the tip cross-sectional area of the ground electrode tip 8 of the spark plug 1 of this embodiment is represented by $A_{g1}$, and the tip cross-sectional area of the center electrode tip 9 is represented by $A_{c1}$, as shown in FIG. 4, the tip cross-sectional area $A_{g1}$ and the tip cross-sectional area $A_{c1}$ respectively correspond to the end surface area of the ground electrode tip 8 and the end surface area of the center electrode tip 9, since each of the ground electrode tip 8 and the center electrode tip 9 has a circular columnar shape; the end surface of each of the ground electrode tip 8 and the center electrode tip 9 is a flat surface; and these end surfaces are parallel to each other. Even when these end surfaces are not strictly parallel to each other such a problem would otherwise occur due to error in production, the end surface area of each noble metal tip may be regarded as being the tip cross-sectional area thereof.

In the case where the aforementioned noble metal tip is provided on at least one of the center electrode and the ground electrode of the spark plug (particularly on the ground electrode), even when the spark plug of the first invention is employed under severe environmental conditions (e.g., an internal combustion engine having a supercharger, or an internal combustion engine employing a high-energy coil), the spark plug can maintain its intended performance, since the noble metal tip exhibits excellent erosion resistance, breakage resistance, and separation resistance.

The spark plug 1 is produced through, for example, the following procedure. The noble metal tip 8 or 9 may be produced through, for example, a process in which a tip material is prepared by mixing components so that the proportions thereof fall within the aforementioned ranges; the material is melted, and the molten material is processed into a plate material through hot rolling or a similar technique; and the plate material is formed into tips having a specific shape through hot punching; or a process in which an alloy is processed into a wire-like or rod-like material through hot rolling, hot casting, or hot wire drawing, and the thus-processed material is longitudinally cut into tips having a specific length.

The center electrode 4 and/or the ground electrode 7 may be produced through, for example, the following process: a molten alloy having an intended composition is prepared by means of a vacuum melting furnace; a cast ingot is prepared from the molten alloy through vacuum casting; and the cast ingot is appropriately processed to have specific shape and dimensions through, for example, hot working or wire drawing. The center electrode 4 may be formed by inserting the inner member 14 into the outer member 13 formed to have a cup shape, followed by a plastic working process such as extrusion. When the ground electrode 7 is formed of an outer layer and an axial member provided in a core portion of the outer layer (not illustrated), the axial member is inserted into the outer layer having a cup shape, and then the resultant product is subjected to a plastic working process (e.g., extrusion), followed by plastic working for forming the product into a generally rectangular columnar shape.

Subsequently, one end portion of the ground electrode 7 is bonded, through electric resistance welding, laser welding, or a similar technique, to the end surface of the metallic shell 2 formed to have a specific shape through, for example, plastic working. The metallic shell having the ground electrode bonded thereto is subjected to Zn plating or Ni plating. Trivalent chromate treatment may be carried out after Zn plating or Ni plating.

Next, the above-produced noble metal tip 8 or 9 is fusion-bonded to the ground electrode 7 or the center electrode 4 through, for example, resistance welding and/or laser welding. When the noble metal tip 8 or 9 is bonded to the ground electrode 7 and/or the center electrode 4 through resistance welding, for example, the noble metal tip 8 or 9 is placed on a specific position of the ground electrode 7 and/or the center electrode 4, and resistance welding is carried out while the noble metal tip is pressed onto the specific position. When the noble metal tip 8 or 9 is bonded to the ground electrode 7 and/or the center electrode 4 through laser welding, for example, the noble metal tip 8 or 9 is placed on a specific position of the ground electrode 7 and/or the center electrode 4, and a laser beam is radiated in an obliquely downward direction with respect to the noble metal tip 8 so that the laser beam is applied to a portion or the entirety of the contact portion between the noble metal tip 8 or 9 and the ground electrode 7 and/or the center electrode 4. Laser welding may be carried out after resistance welding.

Separately, the insulator 3 having a specific shape is formed through firing of, for example, a ceramic material. The center electrode 4 having the noble metal tip 9 bonded thereto is inserted into the axial hole 20 of the insulator 3, and glass powder for forming a glass seal, a resistor composition for forming the resistor 5, and the aforementioned glass powder are sequentially charged into the axial hole 20 under preliminary compression. Subsequently, while the metallic terminal 6 is pressed into the axial hole 20 through its end, the resistor composition and the glass powder are pressure-heated. Thus, the resistor composition and the glass powder are sintered, to thereby form the resistor 5 and a glass seal layer. Next, the insulator 3 having the center electrode 4, etc. fixed thereto is assembled into the metallic shell 2 having the ground electrode 7 bonded thereto. Finally, the distal end portion of the ground electrode 7 is bent toward the center electrode 4 such that one end of the ground electrode 7 faces the front end portion of the center electrode 4, to thereby produce the spark plug 1.

Figure 5:
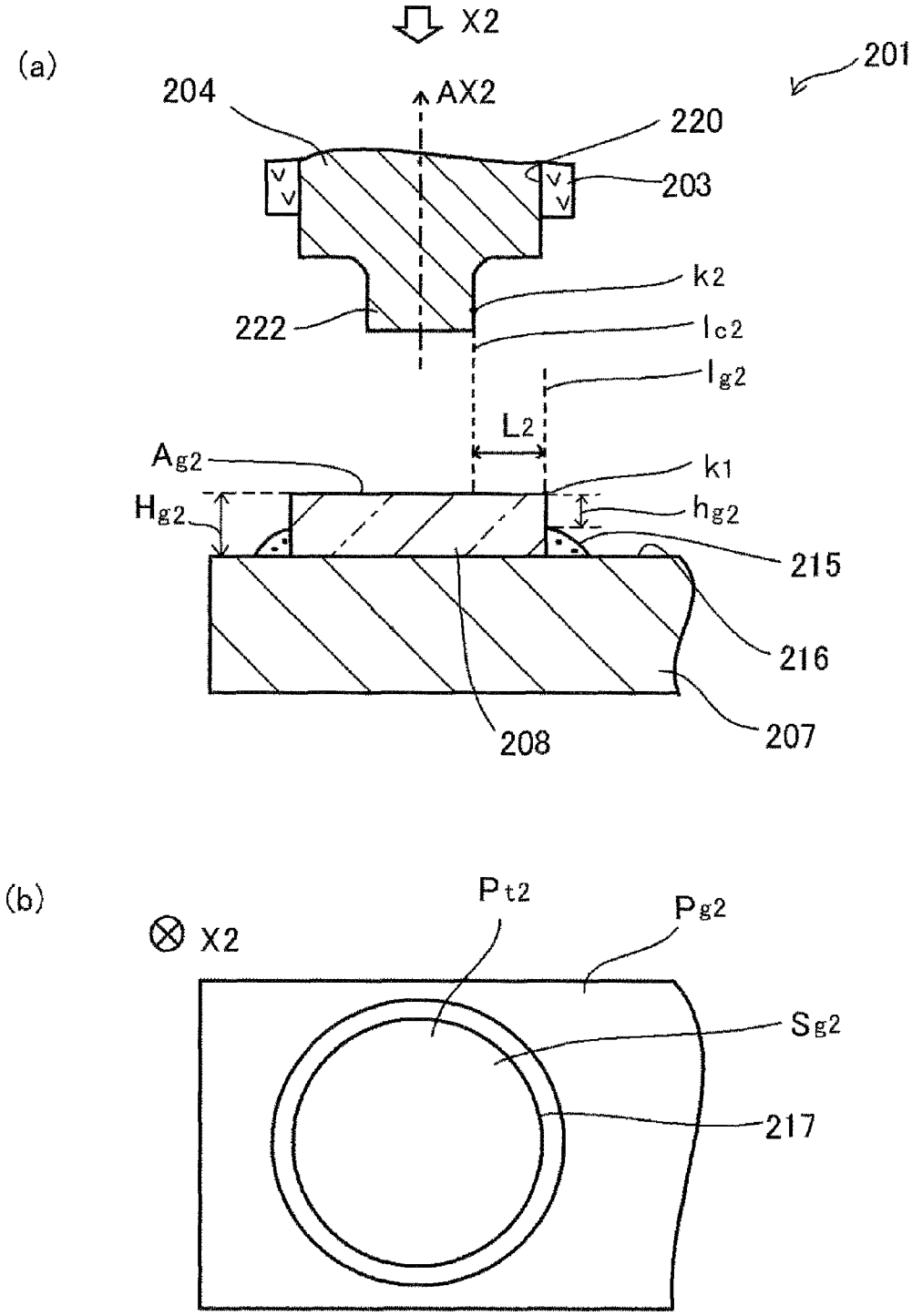
FIG. 5(*a*) is a cross-sectional view of an ignition portion of another embodiment of the spark plug of the present invention.

FIG. 5 shows another embodiment of the spark plug of the first invention. FIG. 5(*a*) is a cross-sectional view of an ignition portion of another embodiment of the spark plug of the first invention. FIG. 5(*b*) shows a main portion of a ground electrode as viewed in a direction X2 shown in FIG. 5(*a*).

The spark plug 201 of this embodiment has the same configuration as the spark plug 1 shown in FIG. 4, except that a ground electrode tip 208 is bonded to a bonding surface 216 of a ground electrode 207 through resistance welding, and thus a welded portion 215 having a very small volume (the portion may be referred to as "weld flash") is formed on an outer peripheral portion of the ground electrode tip 208, and a center electrode 204 has, on its front end portion, a center electrode protrusion 222 (which may be referred to as "facing metallic protrusion") instead of provision of a center electrode tip on the front end surface of the center electrode 204.

Therefore, in the ground electrode tip 208 of the spark plug 201 of this embodiment, a welding area $S_{g2}$, a tip protrusion height $H_{g2}$, a covering length $L_2$, a tip-welded portion distance $h_{g2}$, and a tip cross-sectional area $A_{g2}$ are defined in a manner similar to the case of the spark plug 1. Since the center electrode 204 is not provided with a noble metal tip 209, welding area, tip protrusion height, tip-welded portion distance, and tip cross-sectional area are not defined in the center electrode 204.

Figure 6:
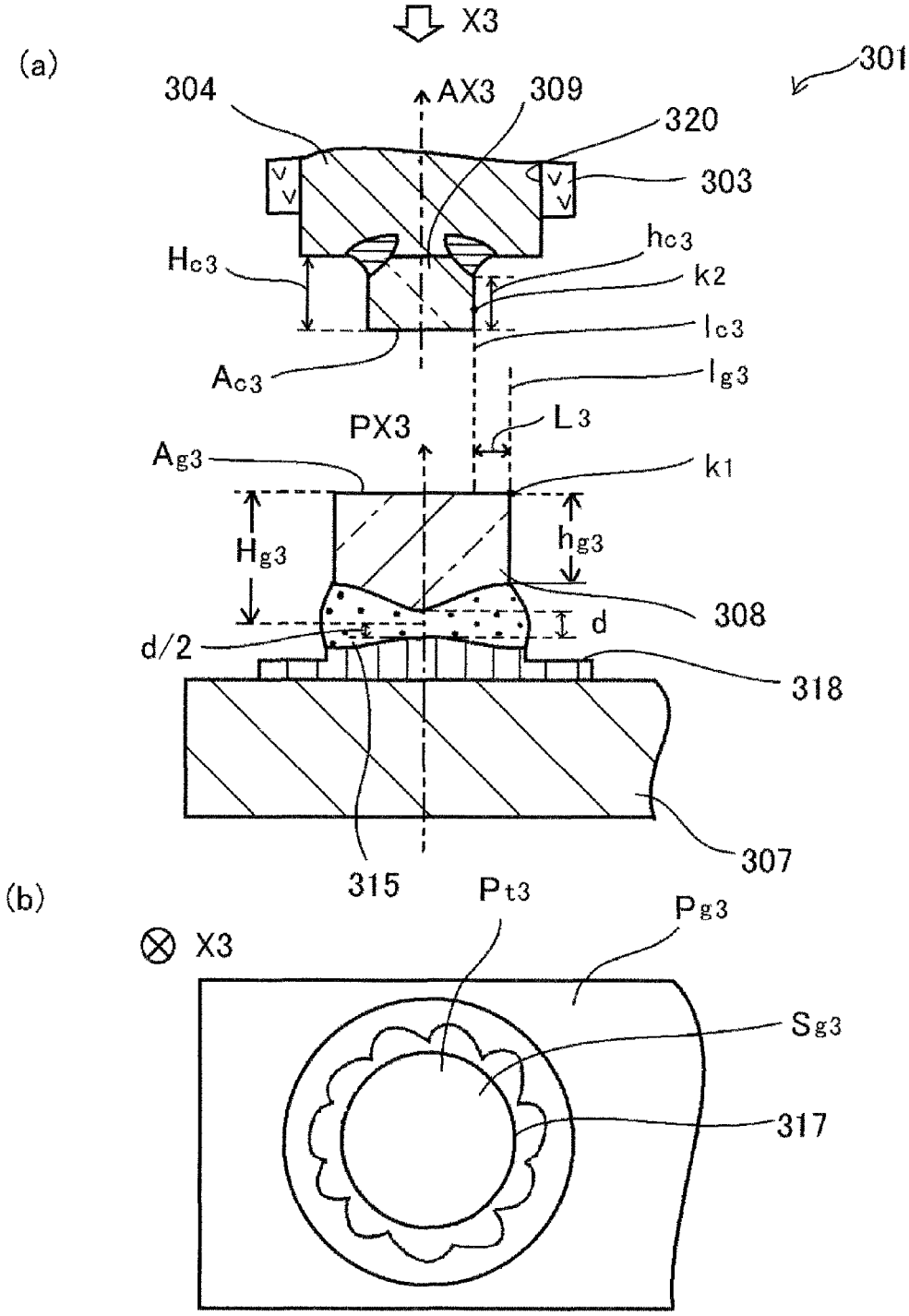
FIG. 6(*a*) is a cross-sectional view of an ignition portion of yet another embodiment of the spark plug of the present invention.

FIG. 6 shows yet another embodiment of the spark plug of the first invention. FIG. 6(*a*) is a cross-sectional view of an ignition portion of yet another embodiment of the spark plug of the first invention. FIG. 6(*b*) shows a main portion of a ground electrode as viewed in a direction X3 shown in FIG. 6(*a*).

The spark plug 301 of this embodiment has the same configuration as the spark plug 1 shown in FIG. 4, except that a base 318 is provided on the top surface of a ground electrode 307 which faces a center electrode 304; a ground electrode tip 308 is provided, via a welded portion 315, on the surface of the base 318 opposite the surface bonding to the ground electrode 307; and the welded portion 315 is provided between the ground electrode tip 308 and the base 318 such that the ground electrode tip 308 is not in contact with the base 318.

Therefore, in the ground electrode tip 308 of the spark plug 301 of this embodiment, a welding area $S_{g3}$, a covering length $L_3$, a tip-welded portion distance $h_{g3}$, and a tip cross-sectional area $A_{g3}$ are defined in a manner similar to the case of the spark plug 1. Also, in the center electrode tip 309, a welding area $S_{c3}$, a tip protrusion height $H_{c3}$, a tip-welded portion distance $h_{c3}$, and a tip cross-sectional area $A_{c3}$ are defined in a manner similar to the case of the spark plug 1.

In the spark plug 301 of this embodiment, since the welded portion 315 is provided between the ground electrode tip 308 and the base 318 so as to cover the entire top surface of the base 318, the ground electrode tip 308 is not in direct contact with the base 318. Therefore, the tip protrusion height $H_{g3}$ is the distance between a point corresponding to ½ the thickness of the thinnest portion of the welded portion 315 in a direction of an axis PX3 of the ground electrode tip 308, and the end surface of the ground electrode tip 308 most distal from the point in the direction of the axis PX3.

Figure 7:
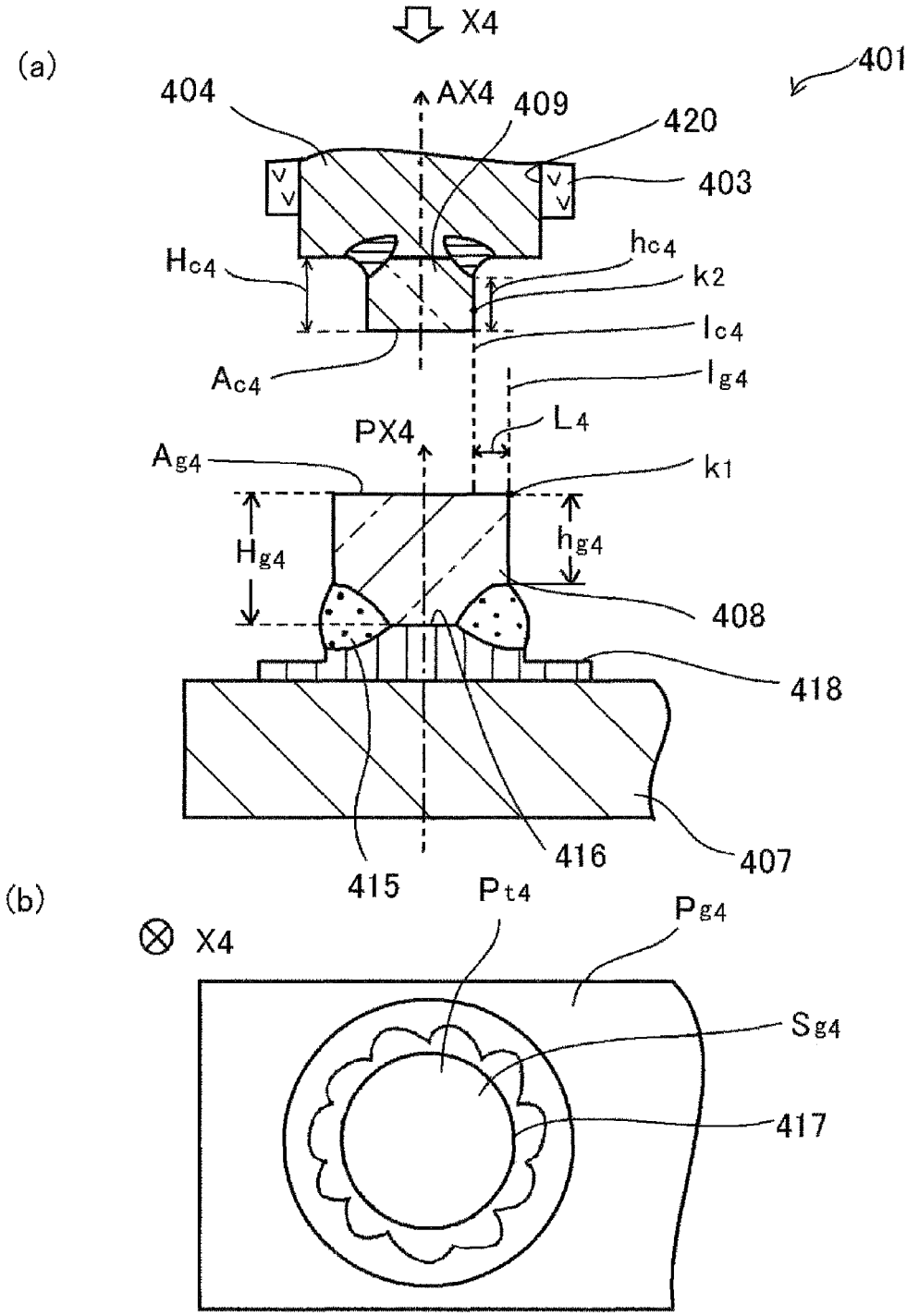
FIG. 7(*a*) is a cross-sectional view of an ignition portion of yet another embodiment of the spark plug of the present invention.

FIG. 7 shows yet another embodiment of the spark plug of the first invention. FIG. 7(*a*) is a cross-sectional view of an ignition portion of yet another embodiment of the spark plug of the first invention. FIG. 7(*b*) shows a main portion of a ground electrode as viewed in a direction X4 shown in FIG. 7(*a*).

The spark plug 401 of this embodiment has the same configuration as the spark plug 301 shown in FIG. 6, except that a base 418 is provided on the top surface of a ground electrode 407 which faces a center electrode 404; a ground electrode tip 408 is provided, via a welded portion 415, on the surface of the base 418 opposite the surface bonding to the ground electrode 407; and the ground electrode tip 408 is in partial contact with the base 418 without the intervention of the welded portion 415.

Therefore, in the ground electrode tip 408 of the spark plug 401 of this embodiment, a welding area $S_{g4}$, a covering length $L_4$, a tip-welded portion distance $h_{g4}$, and a tip cross-sectional area $A_{g4}$ are defined in a manner similar to the case of the spark plug 1. Also, in the center electrode tip 409, a welding area $S_{c4}$, a tip protrusion height $H_{c4}$, a tip-welded portion distance $h_{c4}$, and a tip cross-sectional area $A_{c4}$ are defined in a manner similar to the case of the spark plug 1.

In the spark plug 401 of this embodiment, since the welded portion 415 is provided between the ground electrode tip 408 and the base 418 so as not to cover the entire top surface of the base 418, the tip protrusion height $H_{g4}$ is the distance between a bonding surface 416 of the base 418 to which the ground electrode tip 408 is bonded, and the surface of the ground electrode tip 408 most distal from the bonding surface 416, the distance being determined in a direction in which the ground electrode tip 408 faces the center electrode tip 409.

Figure 8:
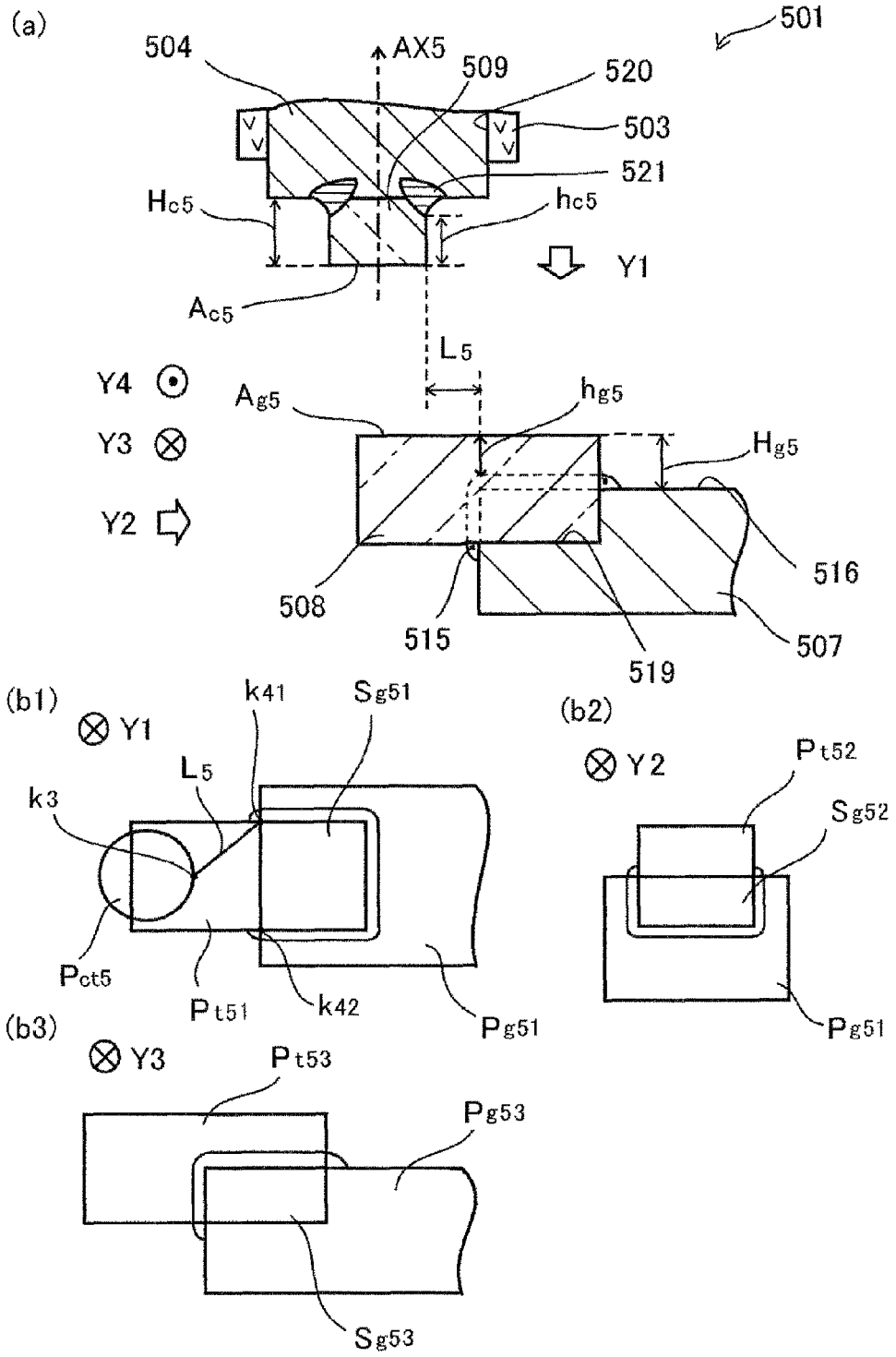
FIG. 8(*a*) is a cross-sectional view of an ignition portion of yet another embodiment of the spark plug of the present invention.

FIG. 8 shows yet another embodiment of the spark plug of the first invention. FIG. 8(*a*) is a cross-sectional view of an ignition portion of yet another embodiment of the spark plug of the first invention. FIGS. 8(*b*1), 8(*b*2), and 8(*b*3) respectively show projection regions formed by projection of a center electrode tip, a ground electrode tip, and/or a ground electrode on surfaces perpendicular to view directions $Y_1$, $Y_2$, and $Y_3$.

The spark plug 501 of this embodiment has the same configuration as the spark plug 1 shown in FIG. 4, except that a ground electrode tip 508 has a rectangular columnar shape; a portion of the rectangular columnar tip is fitted into a notch 519 provided so as to open at the front end surface and peripheral side surface of a ground electrode 507; four of the six surfaces of the rectangular columnar tip are bonded to the four surfaces of the notch 519; and the ground electrode tip 508 is provided so as to project from the ground electrode 507 in a direction perpendicular to an axis AX5 of the center electrode 504. The spark plug 501 of this embodiment encompasses a mode in which the ground electrode tip 508 is fitted into a dent formed in the ground electrode 507 by pressing the ground electrode tip 508 onto the ground electrode 507 during fusion-bonding of the ground electrode tip 508 to a flat surface of the ground electrode 507. Thus, the notch 519 may be formed on the ground electrode 507 before the ground electrode tip 508 is fitted into the notch 519, or may be formed during fusion-bonding of the ground electrode tip 508 to the ground electrode 507.

Therefore, in the center electrode tip 509 of the spark plug 501 of this embodiment, a welding area $S_{c5}$, a tip protrusion height $H_{c5}$, a tip-welded portion distance $h_{c5}$, and a tip cross-sectional area $A_{c5}$ are defined in a manner similar to the case of the spark plug 1.

In the spark plug 501 of this embodiment, since four of the six surfaces of the rectangular columnar ground electrode tip 508 are bonded to the four surfaces of the notch 519 of the ground electrode 507, the welding area $S_{g5}$ of the ground electrode tip 508 is the total of areas $S_{g51}$, $S_{g52}$, $S_{g53}$, and $S_{g54}$ (i.e., $S_{g51}+S_{g52}$, $S_{g53}+S_{g54}$), which are the areas of regions wherein, as viewed in directions $Y_1$, $Y_2$, $Y_3$, and $Y_4$ which are perpendicular to the four surfaces of the notch 519, projection regions $P_{g51}$, $P_{g52}$, $P_{g53}$, and $P_{g54}$ formed by projection of the ground electrode 507 on surfaces perpendicular to the directions $Y_1$, $Y_2$, $Y_3$, and $Y_4$ overlap projection regions $P_{t51}$, $P_{t52}$, $P_{t53}$, and $P_{t54}$ formed by projection of the ground electrode tip 508 on surfaces perpendicular to the directions $Y_1$, $Y_2$, $Y_3$, and $Y_4$ (see FIGS. 8(*b*1) to 8(*b*3)).

The tip protrusion height $H_{g5}$ is the distance between a bonding surface 516 of the ground electrode 507 and the end surface of the ground electrode tip 508 most distal from the bonding surface 516, the distance being determined in a direction in which the ground electrode tip 508 faces the center electrode tip 509. The bonding surface 516 is the surface (exclusive of a portion on which the notch 519 is provided) of the ground electrode 507 in a direction in which the ground electrode tip 508 faces the center electrode tip 509.

The covering length $L_5$ is defined as described below, since, unlike the case of the spark plug 1 shown in FIG. 4, the ground electrode tip 508 is provided on the ground electrode 507 so as to project from the ground electrode 507 in a direction perpendicular to the axis AX5, and the front end surface of the center electrode tip 509 faces the ground electrode tip 508 in the direction of the axis AX5. Specifically, as shown in FIG. 8(*b*1), the covering length $L_5$ is the distance, as viewed in the direction of the axis AX5, between a point k3 on a projection region $P_{ct5}$ formed by projection of the front end surface of the center electrode tip 509 on a virtual surface perpendicular to the direction of the axis AX5, and an intersection point k41 of two intersection points k41 and k42, which points are provided by intersection of the contour of the projection region $P_{g51}$ formed by projection of the ground electrode 507 on the virtual surface with the contour of the projection region $P_{t5}$ formed by projection of the ground electrode tip 508 on the virtual surface, the distance between the points k3 and k41 being shorter than that between the points k3 and k42.

In the ground electrode tip 508, the tip-welded portion distance $h_{g5}$ is the distance as measured, on a surface of the ground electrode tip 508 which includes the point k41 and is parallel to the axis AX5, from the end of the ground electrode tip 508 to the boundary between the tip 508 and the welded portion.

In the center electrode tip 509, the tip-welded portion distance $h_{c5}$ is the distance in the direction of the axis AX5 as measured, on a surface of the center electrode tip 509 which includes the point k3 and is parallel to the axis AX5, from the end of the center electrode tip 509 to the boundary between the tip 509 and the welded portion 521 of the center electrode 504.

Since the ground electrode tip 508 has a rectangular columnar shape, and each of the six surfaces thereof is a flat surface, the tip cross-sectional area $A_{g5}$ of the ground electrode tip 508 is the area of the surface of the ground electrode tip 508 that faces the center electrode tip 509.

Figure 9:
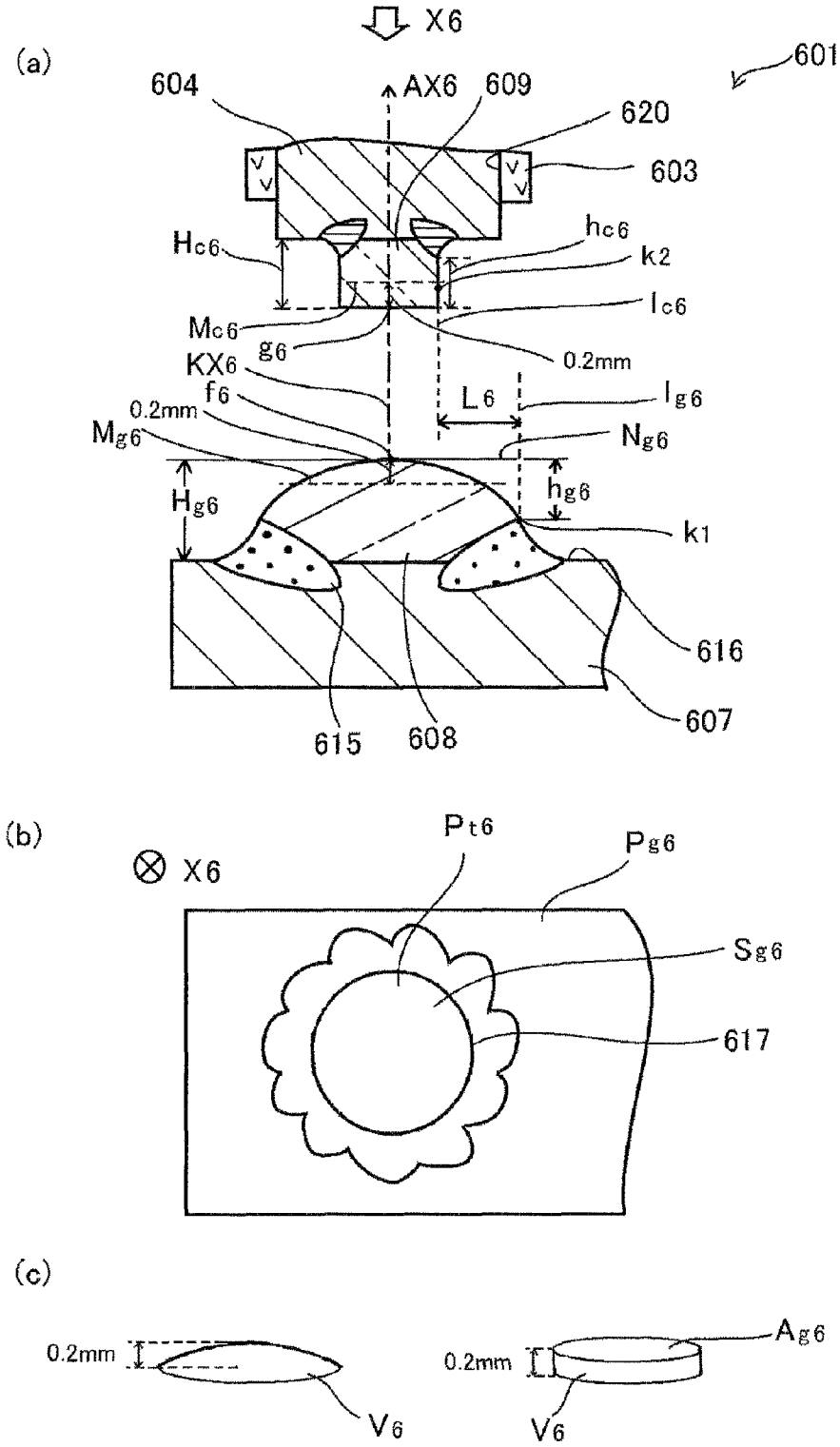
FIG. 9(*a*) is a cross-sectional view of an ignition portion of yet another embodiment of the spark plug of the present invention.

FIG. 9 shows yet another embodiment of the spark plug of the first invention. FIG. 9(*a*) is a cross-sectional view of an ignition portion of yet another embodiment of the spark plug of the first invention. FIG. 9(*b*) shows a main portion of a ground electrode as viewed in a direction X6 shown in FIG. 9(*a*). FIG. 9(*c*) is a representation illustrating a tip cross-sectional area $A_{g6}$ of a ground electrode tip.

The spark plug 601 of this embodiment has the same configuration as the spark plug 1 shown in FIG. 4, except that a ground electrode tip 608 has a hemispherical shape.

Therefore, in the ground electrode tip 608 of the spark plug 601 of this embodiment, a welding area $S_{g6}$, a tip protrusion height $H_{g6}$, a covering length $L_6$, and a tip-welded portion distance $h_{g6}$ are defined in a manner similar to the case of the spark plug 1. Also, in a center electrode tip 609, a welding area $S_{c6}$, a tip protrusion height $H_{c6}$, a tip-welded portion distance $h_{c6}$, and a tip cross-sectional area $A_{c6}$ are defined in a manner similar to the case of the spark plug 1.

In the spark plug 601 of this embodiment, since the end surface of the ground electrode tip 608 is not flat, the tip cross-sectional area $A_{g6}$ of the ground electrode tip 608 is defined as follows. Specifically, the tip cross-sectional area $A_{g6}$ is the area of the base of a virtual cylinder having a height of 0.2 mm and a volume $V_6$ which is equal to the volume $V_6$ of a portion formed by the surface of the ground electrode tip 608 and a plane $M_{g6}$, the plane $M_{g6}$ being parallel to the front end surface of the center electrode tip 609 and being distant 0.2 mm away from a point $f_6$ (which is the intersection point between the surface of the ground electrode tip 608 and a straight line $KX_6$, the straight line $KX_6$ corresponding to the minimum distance between the ground electrode tip 608 and the center electrode tip 609), and the plane $M_{g6}$ being on the side opposite, with respect to the point $f_6$, a point $g_6$ (which is the intersection point of the surface of the center electrode tip 609 and the straight line $KX_6$) (see FIG. 9(*c*)).

Also, when the end surface of the ground electrode tip 608 is a flat surface, but the cross-sectional area of the ground electrode tip 608 in a direction perpendicular to the axis of the tip 608 varies along the axis (for example, when the ground electrode tip 608 has a tapered shape such that the diameter thereof increases toward the ground electrode 607), the cross-sectional area of the ground electrode tip 608 is not the area of the end surface thereof, but is defined as in the case of the aforementioned tip cross-sectional area $A_{g6}$.

(Second Invention)

The spark plug of the second invention includes a center electrode and a ground electrode, wherein one end of the center electrode faces one end of the ground electrode via a gap, and a noble metal tip is provided on at least one of the center electrode and the ground electrode. No particular limitation is imposed on the configuration of a portion other than a main portion of the spark plug of the second invention, so long as the main portion of the spark plug has the aforementioned configuration. That is, the portion other than the main portion may have any known configuration. The spark plug of the second invention has the same configuration as the spark plug 1 shown in FIG. 1, except that the compositions of the center electrode tip and the ground electrode tip differ from those of the center electrode tip 9 and the ground electrode tip 8 described above with reference to FIG. 1.

In the spark plug of the second invention, at least one of the ground electrode tip and the center electrode tip is formed of the below-described tip material. Preferably, the ground electrode tip, which is heated to a higher temperature, is formed of the below-described tip material.

Figure 10:
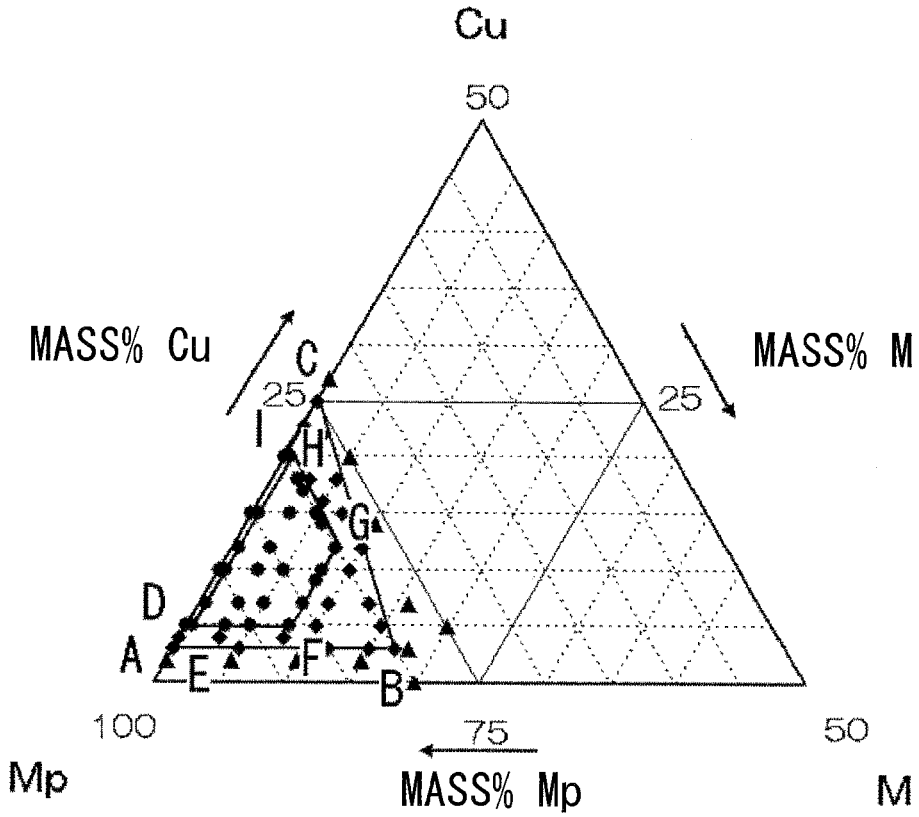
FIG. 10 is a ternary composition diagram showing the proportions by mass of Mp, Cu, and M contained in a noble metal tip provided in the spark plug of the present invention.

The tip material forming each of these noble metal tips contains Mp (Mp is an element group consisting of Pt or Pt and Pd, and the amount of Pd is 20 mass % or less with respect to the mass of the noble metal tip), Cu, and M (M is at least one element selected from the element group consisting of Rh, Ir, Ru, Re, and W) in a total amount of 95 mass % or more, wherein the proportions by mass of Mp, Cu, and M (Mp, Cu, M) in the Mp-Cu-M ternary composition diagram shown in FIG. 10 fall within a region defined by a line connecting point A (97, 3, 0), point B (80, 3, 17), point C (75, 25, 0), and point A (97, 3, 0) in this order (the region including the line).

When the tip material contains Mp, Cu, and M in an amount of 95 mass % or more; the proportions by mass of the three components (Mp, Cu, M) fall within a region defined by a line connecting points A, B, C, and A in this order (the region includes the line) in the Mp-Cu-M ternary composition diagram shown in FIG. 10; and the noble metal tip has the below-described structure, the noble metal tip of the spark plug exhibits excellent erosion resistance, separation resistance, and breakage resistance. That is, even in the case where the range of the composition of the noble metal tip falls outside that of the composition of the aforementioned noble metal tip of the first invention, when the composition of the noble metal tip falls within a specific range, and the noble metal tip has a specific structure, the noble metal tip of the spark plug exhibits excellent erosion resistance, separation resistance, and breakage resistance.

Next will be described the effect of the composition of the noble metal tip under assumption that the noble metal tip has a specific structure as shown below.

When the amount of Cu is 3 mass % or more (particularly 5 mass % or more) in the ternary composition diagram shown in FIG. 10, the tip material exhibits excellent separation resistance, since the difference in thermal expansion coefficient decreases between the tip material and an Ni-based alloy employed as a material for forming the center electrode or the ground electrode. Since the tip material can suppress lowering of melting point, as compared with a Pt—Ni alloy, which is known as a material for effectively improving separation resistance, the tip material exhibits excellent spark erosion resistance, as well as excellent separation resistance. In addition, in the tip material, crystal grain size is less likely to increase, as compared with the case of a Pt—Rh alloy, in which crystal grain size tends to increase. Since internal oxidation is suppressed in the tip material, as compared with the case of a Pt—Ir alloy, the tip material exhibits excellent breakage resistance.

When the amount of Cu is less than 3 mass % in the ternary composition diagram, the aforementioned effects may fail to be attained. When the amount of Cu exceeds 25 mass % in the ternary composition diagram; i.e., when the amount of Cu, which is easily oxidized, increases, oxidation resistance may be lowered, and internal oxidation may occur in crystal grain boundaries, resulting in breakage or separation of the tip. In addition, such a problem may cause impairment of thermal conductivity, which may adversely affect erosion resistance.

When the tip material contains M (particularly when the amount of M is 0.5 mass % or more in the ternary composition diagram), the tip material exhibits excellent spark erosion resistance, since M has a high melting point. Also, since crystal grain size decreases, falling of crystal grains, which is caused by breakage in the tip, can be suppressed. In addition, since the tip material exhibits high strength, even when it comes into contact with and is impacted by a jig during a production process, deformation of the noble metal tip can be suppressed. Thus, the tip material exhibits excellent impact resistance.

However, when the amount of M exceeds 17 mass % in the ternary composition diagram, embrittlement may occur, and thus proccessability is impaired, and breakage of the tip, which is caused by thermal stress or internal corrosion, is likely to occur. Since M has a low thermal expansion coefficient, when a large amount of M is incorporated, the difference in thermal expansion coefficient increases between the tip material and an Ni-based alloy employed as an electrode material, which adversely affects separation resistance. Therefore, the amount of M is 17 mass % or less (preferably 8 mass % or less) in the ternary composition diagram.

The effects of Cu and M in the tip material have been described above. Needless to say, the tip material is greatly affected not only by the proportion by mass of a single component, but also by the proportions by mass of three components (Mp, Cu, M). When the total amount of Cu and M contained in the tip material is equal to or greater than a specific level; i.e., when the proportions by mass of Cu and M exceed levels corresponding to line BC in the ternary composition diagram, at least one of separation resistance, erosion resistance, and tip breakage resistance is deteriorated. Therefore, the proportions by mass of Cu and M are equal to or lower than levels corresponding to line BC (preferably line GH) in the ternary composition diagram.

M is at least one element selected from the element group consisting of Rh, Ir, Ru, Re, and W. Each of Rh, Ir, Ru, Re, and W has a high melting point, and is difficult to sputter. In addition, strength is improved through formation of a solid solution, and crystal grain size can be reduced. Therefore, when the amount of at least one element selected from the element group falls within a region shown in the ternary composition diagram, the noble metal tip of the spark plug exhibits excellent separation resistance, erosion resistance, and breakage resistance. Among the elements of this group, Rh is particularly preferred, since Rh itself is oxidized to form a dense oxide film, whereby oxidation of Cu, etc. can be suppressed.

Mp is an element group consisting of Pt or Pt and Pd, and the amount of Pd is 20 mass % or less with respect to the mass of the noble metal tip. Pt is preferably employed as a main component of the tip material, since it exhibits excellent oxidation resistance, spark erosion resistance, and proccessability. Incorporation of a specific amount of Pd is advantageous in terms of separation resistance, since Pd exhibits excellent oxidation resistance similar to the case of Pt, and has a thermal expansion coefficient greater than that of Pt. Therefore, when the amount of Pd is 20 mass % or less with respect to the entire mass of the noble metal tip formed of the tip material, the noble metal tip of the spark plug exhibits excellent separation resistance, erosion resistance, and breakage resistance. Pd is more inexpensive than Pt. However, when the amount of Pd exceeds 20 mass %, the melting point of the tip material is lowered, resulting in impairment of erosion resistance.

Preferably, the tip material contains at least one element selected from the element group A consisting of Ni, Co, Fe, and Mn, and/or the element group B consisting of Ti, Hf, Y, and rare earth elements; the total mass of the element group A is 5 mass % or less with respect to the entire mass of the noble metal tip formed of the tip material; the total mass of the element group B is 1.5 mass % or less with respect to the entire mass of the noble metal tip formed of the tip material; and the total mass of the element group A and the element group B is less than 5 mass % with respect to the entire mass of the noble metal tip formed of the tip material.

When the total mass of the element group A is more than 0 mass % and 5 mass % or less in the tip material, the tip material exhibits further excellent separation resistance and breakage resistance. Since the element group A has a high thermal expansion coefficient, the difference in thermal expansion coefficient decreases between the tip material and an electrode material, and generation of thermal stress can be suppressed. In addition, since crystal grain size is reduced, the breakage resistance of the tip material is effectively improved.

When the total mass of the element group B is more than 0 mass % and 1.5 mass % or less (particularly 0.01 mass % to 1 mass %) in the tip material, since crystal grain size is reduced, the tip material exhibits excellent breakage resistance.

When the amount of the element group A or the element group B is excessively large in the tip material, the melting point of the tip material may be lowered, resulting in poor erosion resistance. Therefore, the total mass of the element group A and the element group B is preferably less than 5 mass % with respect to the mass of the noble metal tip.

The tip material contains Mp, Cu, and M in a total amount of 95 mass % or more, and substantially contains the element group A consisting of Ni, Co, Fe, and Mn, and the element group B consisting of Ti, Hf, Y, and rare earth elements, as desired. The tip material contains these components such that the amounts of the components fall within the aforementioned ranges, and the total amount of these components and an inevitable impurity is 100 mass %. The tip material may contain a very small amount of a component other than the aforementioned components; i.e., an inevitable impurity such as Ag, B, Ca, Al, Si, or Mg. Preferably, the amount of such an inevitable impurity is reduced to a minimum possible level. However, the tip material may contain such an impurity, so long as the object of the present invention can be achieved. Preferably, the amount of any one of the aforementioned inevitable impurities is 0.1 parts by mass or less, and the total amount of all the inevitable impurities contained in the tip material is 0.2 parts by mass or less, on the basis of 100 parts by mass of the total mass of the aforementioned components.

The amount of each component contained in the noble metal tip formed of the aforementioned tip material may be determined in a manner similar to that described above in the first invention.

The noble metal tip formed of the aforementioned tip material preferably has a hardness of 140 Hv or more, particularly preferably 200 Hv or more.

In the case where the hardness of the noble metal tip falls within the above range, even when the tip comes into contact with a jig during a production process, deformation of the noble metal tip can be prevented.

The hardness of the noble metal tip may be measured in a manner similar to that described above in the first invention. Also, the hardness of the noble metal tip may be adjusted in a manner similar to that described above in the first invention.

In the noble metal tip provided in the spark plug of the second invention, the below-defined welding area S ($mm^2$), tip protrusion height H (mm), covering length L (mm), and tip-welded portion distance h (mm) satisfy the following relations: (a) $H \leq 0.13S+1.18$, (b) $S \leq 5$, and (c) $0.1 \leq h$ or $0.03 \leq L$.

In the noble metal tip, preferably, the below-defined tip cross-sectional area A ($mm^2$) satisfies the following relation: (d) $0.2 \leq A \leq 1.8$.

When, in the noble metal tip, welding area S and tip protrusion height H satisfy the following relation: (a) $H \leq 0.13S+1.18$, the noble metal tip of the spark plug exhibits excellent erosion resistance. In order to improve the erosion resistance of the noble metal tip, preferably, the heat dissipation of the noble metal tip is increased. Hitherto, it has been considered that when welding area S is small, the contact area between the noble metal tip and the electrode is reduced, and thus heat received by the noble metal tip is less likely to be transferred to the electrode, resulting in poor heat dissipation. However, the present inventors have found that heat dissipation is affected not only by welding area S, but also by tip protrusion height H. That is, even in the case where welding area S is small, when tip protrusion height H is smaller than a specific value, overheating of the noble metal Lip can be suppressed, and favorable erosion resistance is achieved. Conversely, even in the case where tip protrusion height H is large, when welding area S is large, favorable heat dissipation is achieved, and thus overheating of the noble metal tip can be suppressed.

When, in the noble metal tip, welding area S, covering length L, and tip-welded portion distance h satisfy the following relations: (b) $S \leq 5$ and (c) $0.1 \leq h$ or $0.03 \leq L$, the noble metal tip of the spark plug exhibits excellent separation resistance. When welding area S is large, high thermal stress is generated particularly in an outer peripheral portion of the noble metal tip due to the difference in thermal expansion coefficient between the tip material forming the noble metal tip and the material forming the electrode, and thus the noble metal tip is likely to be detached from the electrode. Therefore, welding area S is 5 or less. Since highly turbulent airflow occurs in a combustion chamber, when covering length L and tip-welded portion distance h fall outside the above ranges, discharge is likely to occur at a portion of the electrode in the vicinity of the outer periphery of the noble metal tip and/or at the welded portion. Since the electrode or the welded portion has a melting point lower than that of the noble metal tip, the electrode or the welded portion is easily eroded, and the boundary between the noble metal tip and the electrode or the welded portion is hollowed, resulting in poor separation resistance. In addition, when the electrode or the welded portion is eroded, welding area S is substantially reduced, which adversely affects erosion resistance. Therefore, tip-welded portion distance h is 0.1 or more, or covering length L is 0.03 or more.

In the noble metal tip, tip cross-sectional area A preferably satisfies the following relation: (d) $0.2 \leq A \leq 1.8$. When tip cross-sectional are A falls within the above range, further excellent erosion resistance is achieved.

In the second invention, the aforementioned welding area S, tip protrusion height H, covering length L, tip-welded portion distance h, and tip cross-sectional area A are defined in the same manner as described above in the first invention with reference to FIGS. 4 to 9.

The spark plug of the second invention may be produced in the same manner as in the case of the spark plug of the first invention.

The spark plug of the first or second invention is employed as an ignition plug of an internal combustion engine for an automobile (e.g., a gasoline engine). When in use, the spark plug is fixed to a specific position by screwing the threaded portion 10 into a threaded hole provided on a head (not-illustrated) for compartmenting the combustion chamber of the internal combustion engine. The spark plug of the first or second invention can be applied to any internal combustion engine. Particularly preferably, the spark plug is applied to an internal combustion engine having a supercharger or an internal combustion engine employing a high-energy coil, since the spark plug has a noble metal tip exhibiting excellent separation resistance, erosion resistance, and breakage resistance.

The spark plug of the first or second invention is not limited to the aforementioned embodiments, and various modifications may be made, so long as the object of the present invention can be achieved. For example, in the aforementioned spark plug 1, both the center electrode tip 9 and the ground electrode tip 8 are formed of the aforementioned tip material. However, in the present invention, only the center electrode tip 9 may be formed of the tip material, or only the ground electrode tip 8 may be formed of the tip material. In the case of the spark plug of the present invention, generally, the ground electrode is exposed to a higher temperature, as compared with the center electrode. Therefore, preferably, at least the ground electrode tip is formed of the aforementioned tip material.

EXAMPLES (First Invention)

<Preparation of Spark Plug Test Sample A for Evaluation of Erosion Resistance and Tip Breakage Resistance>

An alloy having a composition shown in Tables 1 to 5 was melted to thereby prepare a molten material, and the molten material was processed into a wire-like material by means of at least one process selected from among hot or cold rolling, forging, wire drawing, and swaging. The thus-processed material was longitudinally cut, to thereby produce a circular columnar noble metal tip.

INC601 was subjected to a casting process, to thereby produce a center electrode and a ground electrode. The above-produced noble metal tip for center electrode was bonded to an end surface of the center electrode formed into a rod shape, through resistance welding and subsequent laser welding (hereinafter, the noble metal tip bonded to the center electrode may be referred to as the "center electrode tip"). The above-produced noble metal tip for ground electrode was bonded to a peripheral side surface of an end portion of the ground electrode formed into a generally rectangular columnar shape, through resistance welding and subsequent laser welding (hereinafter, the noble metal tip bonded to the ground electrode may be referred to as the "ground electrode tip"). The noble metal tip was bonded to the surface (width: 3.0 mm) of the ground electrode having a generally rectangular columnar shape (1.6×3.0 mm).

By means of a known technique, one end portion of the ground electrode to which the noble metal tip was not bonded was bonded to one end surface of a metallic shell. Then, the center electrode was assembled into a ceramic insulator, and the insulator was assembled into the metallic shell having the ground electrode bonded thereto. The distal end portion of the ground electrode was bent toward the center electrode so that one end of the ground electrode faced the front end of the center electrode, to thereby produce spark plug test sample A.

The thread diameter of the thus-produced test sample A was M14, and the spark discharge gap between the front end surface of the center electrode tip and the end surface of the ground electrode tip (facing the center electrode tip) was 1.1 mm. Each of the center electrode tip and the ground electrode tip assumed a circular columnar shape (welding area S: 0.2 $mm^2$, tip protrusion height H: 1.4 mm, covering length L: 0 mm, tip-welded portion distance h: 1.0 mm, and tip cross-sectional area A: 0.2 $mm^2$). In the spark plug test sample, the noble metal tip has a circular columnar shape, and is bonded to the electrode through resistance welding and laser welding, as in the case of the spark plug test sample shown in FIG. 4. Hereinafter, the shape of the noble metal tip will be referred to as "circular columnar shape I."

Each of the noble metal tip bonded to the center electrode and the noble metal tip bonded to the ground electrode was found to have a hardness of 140 Hv or more as measured through the aforementioned method. A resistor provided between the center electrode and the terminal shell was found to have a resistance of 5 kΩ.

<Preparation of Spark Plug Test Sample B for Evaluation of Separation Resistance>

Spark plug test sample B was produced in the same manner as in the case of spark plug test sample A, except that ground electrode tip was bonded to the electrode through merely resistance welding (i.e., without laser welding), and the ground electrode tip was formed to assume a circular columnar shape (welding area $S_g$: 5.3 $mm^2$, tip protrusion height $H_g$: 0.2 mm, covering length L: 0.02 mm, tip-welded portion distance $h_g$: 0 mm, and tip cross-sectional area: 5.3 $mm^2$). In the spark plug test sample, the noble metal tip has a circular columnar shape, and is bonded to the electrode through merely resistance welding, as in the case of the spark plug test sample shown in FIG. 5. Hereinafter, the shape of the noble metal tip will be referred to as "circular columnar shape II."

Each of the noble metal tip bonded to the center electrode and the noble metal tip bonded to the ground electrode was found to have a hardness of 140 Hv or more as measured through the aforementioned method. A resistor provided between the center electrode and the terminal shell was found to have a resistance of 5 kΩ.

<Preparation of Spark Plug Test Sample C for Evaluation of Deformation Resistance>

Spark plug test sample C including a ground electrode tip having a different hardness was produced in the same manner as in the case of spark plug test sample A, except that a ground electrode tip having a different hardness was formed by changing processing conditions (e.g., percent processing and processing temperature) for forming the ground electrode tip having a composition shown in Table 6, as well as conditions for welding of the noble metal tip to a ground electrode, and that the ground electrode tip was formed to assume a circular columnar shape (welding area $S_g$: 0.4 $mm^2$, tip protrusion height $H_g$: 1 mm, tip-welded portion distance $h_g$: 0.6 mm, and tip cross-sectional area $A_g$: 0.4 $mm^2$). The ground electrode tip of spark plug test sample C has circular columnar shape I.

<Preparation of Spark Plug Test Sample D for Evaluation of the Effect of the Resistance of Resistor>

Spark plug test sample D (resistance of resistor: 10 kΩ or 15 kΩ) was produced by varying, for example, the mixing proportions of raw materials of a resistor in three spark plug test samples A.

<Evaluation Method>

(Durability Test Method)

The above-produced spark plug test sample A, B, or D was attached to a four-cylinder engine (2,000 cc) having a supercharger. Subsequently, engine rotation speed was maintained at 6,000 rpm in a full throttle state for three minutes, and then idling was performed at an engine rotation speed of 900 rpm. This operation cycle was repeatedly carried out for 300 hours. Thereafter, the erosion resistance, tip breakage resistance, and separation resistance of the spark plug test sample were evaluated as described below.

[Evaluation of Erosion Resistance]

Before and after the aforementioned 300-hour durability test, the gap between the end surface of the center electrode tip and the end surface of the ground electrode tip in the spark plug test sample A or D was measured by means of a pin gauge, and an increase in the gap was calculated. Erosion resistance was evaluated according to the following criteria in terms of gap increase:

X: 0.2 mm or more;

○: 0.15 mm or more and less than 0.2 mm;

◎: 0.12 mm or more and less than 0.15 mm; and

☆: less than 0.12 mm.

The results are shown in Tables 1 to 5 and 7.

[Evaluation of Tip Breakage Resistance]

After the aforementioned 300-hour durability test, the ground electrode having the noble metal tip bonded thereto was cut out of the spark plug test sample A, and the noble metal tip was observed under an SEM (magnification: ×250) in a direction along the spark discharge gap and in a direction perpendicular thereto (i.e., in a circumferential direction of the noble metal tip). Tip breakage resistance was evaluated according to the following criteria:

X: breakage was observed at 10 or more points on the surface of the noble metal tip, or falling of crystal grains was observed;

○: breakage was observed at less than 10 points on the surface of the noble metal tip; and ◎: no breakage was observed on the surface of the noble metal tip.

The results are shown in Tables 1 to 5.

[Evaluation of Separation Resistance]

After the aforementioned 300-hour durability test, the ground electrode having the noble metal tip bonded thereto was cut out of the spark plug test sample B, and then subjected to cutting so that the resultant cross section included the center of the noble metal tip and became parallel to the longitudinal direction of the ground electrode. The cross section was observed under a metallographic microscope for determining the presence or absence of oxide scale.

Figure 11:
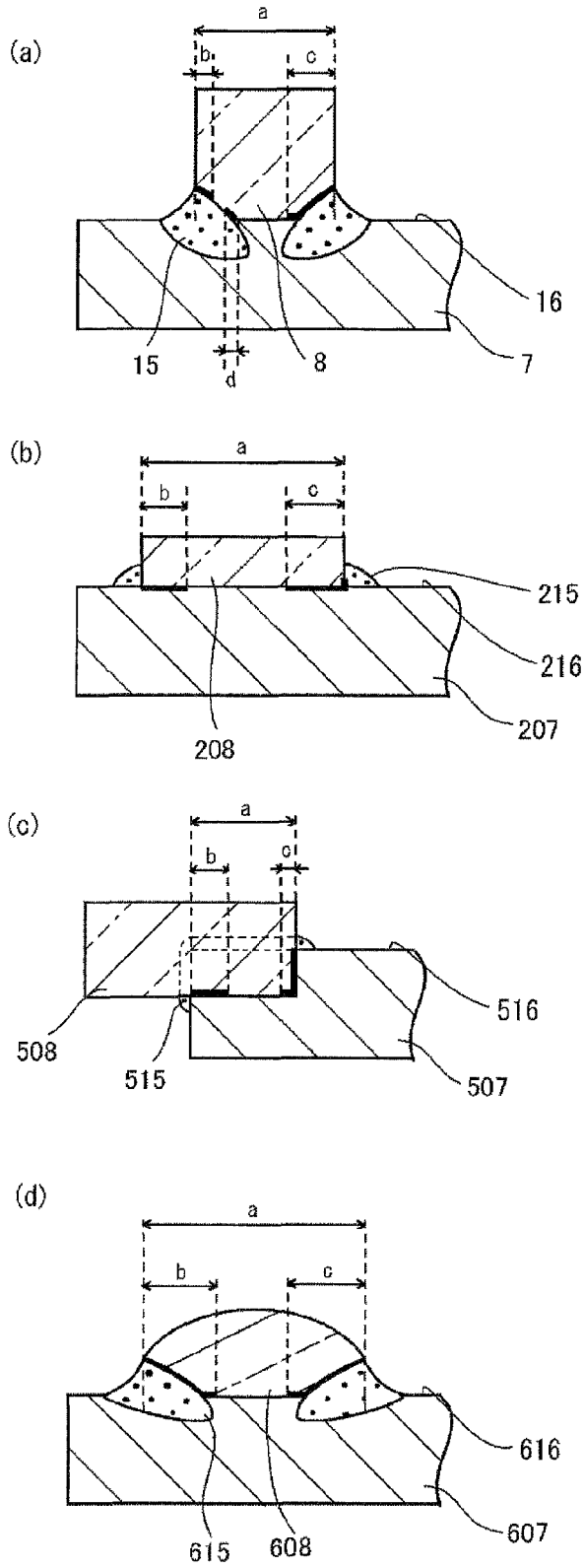
FIGS. 11(*a*) to 11(*d*) are representations illustrating a test for evaluating the separation resistance of a noble metal tip provided in a spark plug.

Oxide scale corresponds to a black portion observed under a metallographic microscope; specifically, an oxidized or detached portion at the boundary between the noble metal tip and the welded portion or the ground electrode. As shown in FIG. 11, the longitudinal length (a) of the ground electrode corresponding to the aforementioned welding area was measured, and also, the lengths of oxide scales (b, c, and d) in this cross section in a direction parallel to the bonding surface 16, 216, 516, or 616 of the ground electrode were measured. The ratio of the total length of (b+c+d) to the length a (hereinafter the ratio may be referred to as "oxide scale ratio") was calculated, and separation resistance was evaluated according to the following criteria:

X: oxide scale ratio was 60% or more;

○: oxide scale ratio was 30% or more and less than 60%; and

◎: oxide scale ratio was less than 30%.

The results are shown in Tables 1 to 5.

(Deformation Resistance Test Method)

Figure 12:
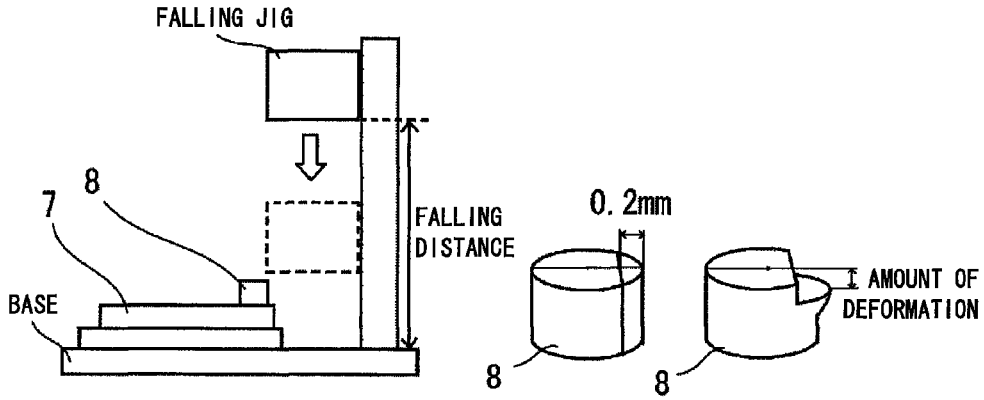
FIG. 12 is a representation illustrating a test for evaluating the impact resistance of a noble metal tip provided in a spark plug.

The ground electrode 7 having the noble metal tip 8 bonded thereto was cut out of the above-produced spark plug test sample X, and was placed on an apparatus shown in FIG. 12 so that the end surface of the circular columnar noble metal tip 8 faced upward. A falling jig (45 g) was caused to fall from a height of 50 mm (as measured from the top surface of a base on which the ground electrode was placed) to collide against the noble metal tip 8, and the amount of deformation of the noble metal tip 8 in a direction of collision between the noble metal tip 8 and the falling jig. The noble metal tip 8 was placed so that the falling jig collided with a portion of the noble metal tip 8 having a width of 0.2 mm as measured from the peripheral side surface toward the center thereof.

[Evaluation of Deformation Resistance]

The above-produced spark plug test sample X was subjected to the aforementioned deformation resistance test, and the amount of deformation of the noble metal tip was determined. Deformation resistance was evaluated according to the following criteria:

X: 250 μm or more;

○: 210 μm or more and less than 250 μm;

◎: 180 μm or more and less than 210 μm; and

☆: less than 180 μm.

The results are shown in Table 6.

The comprehensive evaluation of each spark plug test sample (on the basis of the results of the durability test shown in Tables 1 to 5) was determined according to the following criteria:

X: at least one of the evaluation results of erosion resistance, tip breakage resistance, and separation resistance was X;

○: all of the evaluation results of erosion resistance, tip breakage resistance, and separation resistance were ○;

◎: one of the evaluation results of erosion resistance, tip breakage resistance, and separation resistance was ◎ or ☆;

☆: two of the evaluation results of erosion resistance, tip breakage resistance, and separation resistance were ◎ or ☆; and ☆☆: all of the evaluation results of erosion resistance, tip breakage resistance, and separation resistance were ◎ or ☆.

The proportions by mass of Pt, Cu, and Rh contained in a ground electrode tip having a composition shown in Tables 1 and 2 are shown in FIG. 2. In FIG. 2, "black triangle" corresponds to comprehensive evaluation "×" shown in Tables 1 and 2, and "black circle" corresponds to comprehensive evaluation "○" or "◎." In FIG. 2, Mp corresponds to Pt, and M corresponds to Rh.

TABLE 1

| | | Proportion (mass %) | | | | | Evaluation by durability test | | | |
|---|---|---|---|---|---|---|---|---|---|---|
| No. | | Pt | Cu | Rh | Ni | Ir | Erosion resistance | Tip breakage resistance | Separation resistance | Comprehensive evaluation |
| 1 | Comp. | 80.0 | 0.0 | 0.0 | 20.0 | — | X | ○ | ◎ | X |
| 2 | Ex. | 80.0 | 0.0 | 20.0 | — | — | ☆ | X | X | X |
| 3 | | 80.0 | 0.0 | 0.0 | — | 20.0 | ◎ | X | X | X |
| 4 | | 98.0 | 2.0 | 0.0 | — | — | ○ | ○ | X | X |
| 5 | | 93.0 | 2.0 | 5.0 | — | — | ☆ | ○ | X | X |
| 6 | | 88.0 | 2.0 | 10.0 | — | — | ☆ | ○ | X | X |
| 7 | | 83.0 | 2.0 | 15.0 | — | — | ☆ | ○ | X | X |
| 8 | | 79.0 | 3.0 | 18.0 | — | — | ☆ | X | X | X |
| 9 | | 75.0 | 5.0 | 20.0 | — | — | ☆ | X | X | X |
| 10 | | 77.0 | 7.0 | 16.0 | — | — | ☆ | X | X | X |
| 11 | | 76.0 | 14.0 | 10.0 | — | — | X | X | X | X |
| 12 | | 75.0 | 20.0 | 5.0 | — | — | X | X | ○ | X |
| 13 | | 73.0 | 27.0 | 0.0 | — | — | X | X | ○ | X |
| 14 | | 97.0 | 3.0 | 0.0 | — | — | ○ | ○ | X | X |
| 15 | | 92.0 | 3.0 | 5.0 | — | — | ☆ | ○ | X | X |
| 16 | | 85.0 | 3.0 | 12.0 | — | — | ☆ | ○ | X | X |
| 17 | | 82.0 | 3.0 | 15.0 | — | — | ☆ | ○ | X | X |
| 18 | | 80.0 | 3.0 | 17.0 | — | — | ☆ | ○ | X | X |
| 19 | | 96.0 | 4.0 | 0.0 | — | — | ○ | ○ | X | X |
| 20 | | 93.0 | 4.0 | 3.0 | — | — | ☆ | ○ | X | X |
| 21 | | 88.0 | 4.0 | 8.0 | — | — | ☆ | ○ | X | X |
| 22 | | 85.0 | 5.0 | 10.0 | — | — | ☆ | ○ | X | X |
| 23 | | 80.0 | 5.0 | 15.0 | — | — | ☆ | ○ | X | X |
| 24 | | 83.0 | 7.0 | 10.0 | — | — | ☆ | ○ | X | X |
| 25 | | 80.0 | 7.0 | 13.0 | — | — | ☆ | ○ | X | X |
| 26 | | 80.0 | 10.0 | 10.0 | — | — | ☆ | ○ | X | X |
| 27 | | 78.0 | 12.0 | 10.0 | — | — | ◎ | X | X | X |
| 28 | | 78.0 | 15.0 | 7.0 | — | — | ◎ | X | ○ | X |
| 29 | | 79.0 | 16.0 | 5.0 | — | — | ◎ | X | ○ | X |
| 30 | | 79.0 | 18.0 | 3.0 | — | — | ◎ | X | ○ | X |
| 31 | | 77.0 | 18.0 | 5.0 | — | — | ◎ | X | ○ | X |

TABLE 1-continued

| No. | Proportion (mass %) Pt | Cu | Rh | Ni | Ir | Evaluation by durability test: Erosion resistance | Tip breakage resistance | Separation resistance | Comprehensive evaluation |
|---|---|---|---|---|---|---|---|---|---|
| 32 | 76.0 | 22.0 | 2.0 | — | — | ◎ | X | ○ | X |
| 33 | 77.0 | 23.0 | 0.0 | — | — | ○ | X | ○ | X |
| 34 | 75.0 | 25.0 | 0.0 | — | — | ○ | X | ○ | X |

TABLE 2

| No. | | Proportion (mass %) Pt | Cu | Rh | Ni | Ir | Evaluation by durability test: Erosion resistance | Tip breakage resistance | Separation resistance | Comprehensive evaluation |
|---|---|---|---|---|---|---|---|---|---|---|
| 35 | Ex. | 95.0 | 5.0 | 0.0 | — | — | ○ | ○ | ○ | ○ |
| 36 | | 90.0 | 10.0 | 0.0 | — | — | ○ | ○ | ○ | ○ |
| 37 | | 85.0 | 15.0 | 0.0 | — | — | ○ | ○ | ○ | ○ |
| 38 | | 80.0 | 20.0 | 0.0 | — | — | ○ | ○ | ○ | ○ |
| 39 | | 94.5 | 5.0 | 0.5 | — | — | ☆ | ○ | ○ | ◎ |
| 40 | | 92.0 | 5.0 | 3.0 | — | — | ☆ | ○ | ○ | ◎ |
| 41 | | 90.0 | 5.0 | 5.0 | — | — | ☆ | ○ | ○ | ◎ |
| 42 | | 87.0 | 5.0 | 8.0 | — | — | ☆ | ○ | ○ | ◎ |
| 43 | | 92.5 | 7.0 | 0.5 | — | — | ☆ | ○ | ○ | ◎ |
| 44 | | 90.0 | 7.0 | 3.0 | — | — | ☆ | ○ | ○ | ◎ |
| 45 | | 88.0 | 7.0 | 5.0 | — | — | ☆ | ○ | ○ | ◎ |
| 46 | | 85.0 | 7.0 | 8.0 | — | — | ☆ | ○ | ○ | ◎ |
| 47 | | 83.0 | 9.0 | 8.0 | — | — | ☆ | ○ | ○ | ◎ |
| 48 | | 89.5 | 10.0 | 0.5 | — | — | ☆ | ○ | ○ | ◎ |
| 49 | | 87.0 | 10.0 | 3.0 | — | — | ☆ | ○ | ○ | ◎ |
| 50 | | 85.0 | 10.0 | 5.0 | — | — | ☆ | ○ | ○ | ◎ |
| 51 | | 82.0 | 10.0 | 8.0 | — | — | ☆ | ○ | ○ | ◎ |
| 52 | | 87.5 | 12.0 | 0.5 | — | — | ☆ | ○ | ○ | ◎ |
| 53 | | 85.0 | 12.0 | 3.0 | — | — | ☆ | ○ | ○ | ◎ |
| 54 | | 80.0 | 12.0 | 8.0 | — | — | ☆ | ○ | ○ | ◎ |
| 55 | | 80.0 | 14.0 | 6.0 | — | — | ☆ | ○ | ○ | ◎ |
| 56 | | 84.5 | 15.0 | 0.5 | — | — | ☆ | ○ | ○ | ◎ |
| 57 | | 82.0 | 15.0 | 3.0 | — | — | ☆ | ○ | ○ | ◎ |
| 58 | | 80.0 | 15.0 | 5.0 | — | — | ☆ | ○ | ○ | ◎ |
| 59 | | 80.0 | 17.0 | 3.0 | — | — | ☆ | ○ | ○ | ◎ |
| 60 | | 80.0 | 18.0 | 2.0 | — | — | ☆ | ○ | ○ | ◎ |
| 61 | | 79.5 | 20.0 | 0.5 | — | — | ☆ | ○ | ○ | ◎ |

45

TABLE 3

| No. | | Proportion (mass %) Pt | Cu | Rh | Ir | Ru | Re | W | Evaluation by durability test: Erosion resistance | Tip breakage resistance | Separation resistance | Comprehensive evaluation |
|---|---|---|---|---|---|---|---|---|---|---|---|---|
| 42 | Ex. | 87.0 | 5.0 | 8.0 | | | | | ☆ | ○ | ○ | ◎ |
| 62 | | 87.0 | 5.0 | | 8.0 | | | | ◎ | ○ | ○ | ◎ |
| 63 | | 87.0 | 5.0 | | | 8.0 | | | ◎ | ○ | ○ | ◎ |
| 64 | | 87.0 | 5.0 | | | | 8.0 | | ◎ | ○ | ○ | ◎ |
| 65 | | 87.0 | 5.0 | 3.0 | 5.0 | | | | ◎ | ○ | ○ | ◎ |
| 66 | | 87.0 | 5.0 | 3.0 | 3.0 | 2.0 | | | ◎ | ○ | ○ | ◎ |
| 50 | | 85.0 | 10.0 | 5.0 | | | | | ☆ | ○ | ○ | ◎ |
| 67 | | 85.0 | 10.0 | | 5.0 | | | | ◎ | ○ | ○ | ◎ |
| 68 | | 85.0 | 10.0 | | | | | 5.0 | ◎ | ○ | ○ | ◎ |
| 69 | | 85.0 | 10.0 | 2.0 | 3.0 | | | | ◎ | ○ | ○ | ◎ |

TABLE 4

| No. | | Proportion (mass %) Pt | Cu | Rh | Pd | Evaluation by durability test: Erosion resistance | Tip breakage resistance | Separation resistance | Comprehensive evaluation |
|---|---|---|---|---|---|---|---|---|---|
| 38 | Ex. | 80.0 | 20.0 | | | ○ | ○ | ○ | ○ |
| 70 | | 70.0 | 20.0 | | 10.0 | ○ | ○ | ◎ | ◎ |
| 71 | | 60.0 | 20.0 | | 20.0 | ○ | ○ | ◎ | ◎ |
| 72 | Comp. Ex. | 50.0 | 20.0 | | 30.0 | X | ○ | ◎ | X |

TABLE 5

| No. | | Proportion (mass %) Pt | Cu | Rh | Ir | Ni | Co | Mn | Hf | Ti | Y | La | Evaluation by durability test: Erosion resistance | Tip breakage resistance | Separation resistance | Comprehensive evaluation |
|---|---|---|---|---|---|---|---|---|---|---|---|---|---|---|---|---|
| 35 | Ex. | 95.0 | 5.0 | | | | | | | | | | ○ | ○ | ○ | ○ |
| 73 | | 90.0 | 5.0 | | | 5.0 | | | | | | | ○ | ◎ | ◎ | ☆ |
| 74 | | 90.0 | 5.0 | | | | 5.0 | | | | | | ○ | ◎ | ◎ | ☆ |
| 75 | | 90.0 | 5.0 | | | | | 5.0 | | | | | ○ | ◎ | ◎ | ☆ |
| 76 | Comp. Ex. | 89.0 | 5.0 | | | 6.0 | | | | | | | X | ○ | ◎ | X |
| 46 | Ex. | 85.0 | 7.0 | 8.0 | | | | | | | | | ☆ | ○ | ○ | ◎ |
| 77 | | 83.5 | 7.0 | 8.0 | | | | | 1.5 | | | | ☆ | ◎ | ○ | ☆ |
| 78 | | 83.5 | 7.0 | 8.0 | | | | | | 1.5 | | | ☆ | ◎ | ○ | ☆ |
| 79 | | 83.5 | 7.0 | 8.0 | | | | | | | 1.5 | | ☆ | ◎ | ○ | ☆ |
| 80 | | 83.0 | 7.0 | 8.0 | | | | | | 2.0 | | | ◎ | ◎ | ○ | ☆ |
| 81 | | 83.0 | 7.0 | 8.0 | | | | | | | 2.0 | | ◎ | ◎ | ○ | ☆ |
| 36 | | 90.0 | 10.0 | | | | | | | | | | ○ | ○ | ○ | ○ |
| 82 | | 85.0 | 10.0 | | | 3.5 | | | | | | 1.5 | ○ | ◎ | ◎ | ☆ |
| 83 | Comp. Ex. | 84.5 | 10.0 | | | 3.5 | | | | | | 2.0 | X | X | ◎ | X |

TABLE 6

| No. | | Proportion (mass %) Pt | Cu | Rh | Ir | Evaluation: Hardness | Deformation resistance |
|---|---|---|---|---|---|---|---|
| 84 | Comp. Ex. | 80.0 | | 20.0 | | 210 | X |
| 85 | Ex. | 95.0 | 5.0 | | | 135 | ○ |
| 86 | | 95.0 | 5.0 | | | 140 | ◎ |
| 87 | | 90.0 | 10.0 | | | 100 | ○ |
| 88 | | 90.0 | 10.0 | | | 140 | ◎ |
| 89 | | 89.5 | 10.0 | 0.5 | | 130 | ○ |
| 90 | | 89.5 | 10.0 | 0.5 | | 140 | ◎ |
| 91 | | 89.5 | 10.0 | 0.5 | | 200 | ☆ |
| 92 | | 85.0 | 10.0 | 5.0 | | 185 | ◎ |
| 93 | | 85.0 | 10.0 | 5.0 | | 200 | ☆ |
| 94 | | 85.0 | 10.0 | | 5.0 | 210 | ☆ |

TABLE 7

| No. | | Proportion (mass %) Pt | Cu | Rh | Ni | Resistance (kΩ) | Evaluation Erosion resistance |
|---|---|---|---|---|---|---|---|
| 1 | Comp. Ex. | 80.0 | | | 20.0 | 5 | X |
| 95 | | 80.0 | | | 20.0 | 10 | X |
| 96 | | 80.0 | | | 20.0 | 15 | ○ |
| 35 | Ex. | 95.0 | 5.0 | | | 5 | ○ |
| 97 | | 95.0 | 5.0 | | | 10 | ○ |
| 98 | | 95.0 | 5.0 | | | 15 | ◎ |
| 50 | | 85.0 | 10.0 | 5.0 | | 5 | ☆ |

TABLE 7-continued

| No. | Proportion (mass %) Pt | Cu | Rh | Ni | Resistance (kΩ) | Evaluation Erosion resistance |
|---|---|---|---|---|---|---|
| 99 | 85.0 | 10.0 | 5.0 | | 10 | ☆ |
| 100 | 85.0 | 10.0 | 5.0 | | 15 | ☆ |

As shown in Tables 2 to 7, a spark plug including a noble metal tip falling within the scope of the first invention exhibited excellent erosion resistance, separation resistance, and tip breakage resistance.

In contrast, in the case of a spark plug including a noble metal tip falling outside the scope of the first invention, as shown in Tables 1 and 4 to 7, at least one of erosion resistance, separation resistance, and tip breakage resistance was impaired.

As shown in Table 3, noble metal tips containing any of Rh, Ir, Ru, Re, and W exhibited similar performances. As shown in Table 4, the spark plug (No. 70 or 71) including a noble metal tip containing Pt, Cu, and Pd exhibited excellent separation resistance, as compared with the spark plug (No. 38) including a noble metal tip containing Pt and Cu. As shown in Table 5, the spark plugs (Nos. 73 to 75 and 82) each including a noble metal tip containing at least one of Ni, Co, and Mn exhibited further excellent separation resistance and tip breakage resistance, as compared with the spark plugs (Nos. 35 and 36) each including a noble metal tip not containing such an element. Also, the spark plugs (Nos. 77 to 82) each including a noble metal tip containing any of Hf, Ti, Y, and La exhibited further excellent tip breakage resistance, as compared with the spark plugs (Nos. 35, 46, and 36) each including a noble metal tip not containing such an element.

As shown in Table 6, a spark plug including a noble metal tip falling within the scope of the present invention exhibited further excellent deformation resistance when the hardness of the noble metal tip was 140 Hv or more (particularly 200 Hv or more). As shown in Table 7, a spark plug including a noble metal tip falling within the scope of the present invention exhibited excellent erosion resistance even when the resistance of a resistor was 10 kΩ or less.

(Second Invention)

<Preparation of Spark Plug Test Sample E for Evaluation of Erosion Resistance and Tip Breakage Resistance>

Spark plug test sample E was produced in the same manner as in the case of spark plug test sample A, except that, in a ground electrode tip (noble metal tip) having a composition shown in Tables 8 to 12, tip protrusion height H was adjusted to 1.2 mm, and tip-welded portion distance h was adjusted to 0.8 mm. The noble metal tip of spark plug test sample E has circular columnar shape I.

Each of the center electrode tip and the ground electrode tip was found to have a hardness of 140 Hv or more as measured through the aforementioned method. A resistor provided between the center electrode and the terminal shell was found to have a resistance of 5 kΩ.

<Preparation of Spark Plug Test Sample F for Evaluation of Separation Resistance>

Spark plug test sample F was produced in the same manner as in the case of spark plug test sample B, except that, in a ground electrode tip (noble metal tip) having a composition shown in Tables 8 to 12, welding area S was adjusted to 5 $mm^2$, covering length L was adjusted to 0.03 mm, and tip cross-sectional area A was adjusted to 5 $mm^2$. The center electrode tip and ground electrode tip of spark plug test sample F have circular columnar shape I and circular columnar shape II, respectively.

<Preparation of Spark Plug Test Sample G>

Spark plug test sample G was produced in the same manner as in the case of spark plug test sample E, except that, in a ground electrode tip (noble metal tip) having a composition shown in Table 13, welding area $S_g$ and tip protrusion height $H_g$ were changed by varying the diameter and height of the ground electrode tip. The ground electrode tip of spark plug test sample G has circular columnar shape I. In Table 13, "Pt-18Cu-5Rh" refers to the case where the noble metal tip contains Pt in an amount of 77 mass %, Cu in an amount of 18 mass %, and Rh in an amount of 5 mass % (the same shall apply hereinafter).

<Preparation of Spark Plug Test Sample H>

Spark plug test sample H was produced in the same manner as in the case of spark plug test sample E, except that the shape of a ground electrode tip (noble metal tip) having a composition shown in. Table 14 was changed without changing welding area $S_g$ and tip protrusion height $H_g$ of the ground electrode tip. Regarding the shape of the noble metal tip described in Table 14, "protruded shape" corresponds to a shape similar to that of a ground electrode tip shown in FIGS. 6 and 7; "rectangular columnar shape" corresponds to a shape similar to that of a ground electrode tip shown in FIG. 8; and "hemispherical shape" corresponds to a shape similar to that of a ground electrode tip shown in FIG. 9.

<Preparation of Spark Plug Test Sample I>

Spark plug test sample I was produced in the same manner as in the case of spark plug test sample F, except that, in a ground electrode tip having a Composition shown in Table 15, welding area $S_g$ was changed by varying the diameter of the ground electrode tip and welding conditions. In this test sample, covering length L was 0 mm, and tip-welded portion distance $h_g$ was 0.1 mm.

<Preparation of Spark Plug Test Sample J>

Spark plug test sample J was produced in the same manner as in the case of spark plug test sample F, except that, in a ground electrode tip having a composition shown in Table 16, covering length L and tip-welded portion distance $h_g$ were changed by varying the diameter of the ground electrode tip and welding conditions.

<Preparation of Spark Plug Test Sample K>

Spark plug test sample K was produced in the same manner as in the case of spark plug test sample F, except that the shape of a ground electrode tip having a composition shown in Table 17 was changed without changing welding area $S_g$, covering length L, and tip-welded portion distance $h_g$ of the ground electrode tip.

<Preparation of Spark Plug Test Sample L for Evaluation of Deformation Resistance>

Spark plug test sample L including a ground electrode tip having a different hardness was produced in the same manner as in the case of spark plug test sample E, except that a ground electrode tip having a different hardness was formed by changing processing conditions (e.g., percent processing and processing temperature) for forming the ground electrode tip having a composition shown in Table 18, as well as conditions for welding of the noble metal tip to a ground electrode, and that the ground electrode tip was formed to assume a circular columnar shape (welding area $S_g$: 0.4 $mm^2$, tip protrusion height $H_g$: 1 mm, tip-welded portion distance $h_g$: 0.6 mm, and tip cross-sectional area $A_g$: 0.4 $mm^2$). The ground electrode tip of spark plug test sample L has circular columnar shape I.

<Preparation of Spark Plug Test Sample M for Evaluation of the Effect of the Resistance of Resistor>

Spark plug test sample M (resistance of resistor: 10 kΩ or 15 kΩ) was produced by varying, for example, the mixing proportions of raw materials of a resistor in two spark plug test samples E.

<Evaluation Method>

Each of the above-produced spark plug test samples was evaluated through the aforementioned evaluation methods in a manner similar to that described above in the first invention. The comprehensive evaluation of each spark plug test sample (on the basis of the results of the durability test shown in Tables 8 to 12) was determined according to the criteria described above in the first invention. The results are shown in Tables 8 to 19 and FIG. 13.

The proportions by mass of Pt, Cu, and Rh contained in a ground electrode tip having a composition shown in Tables 8 and 9 are shown in FIG. 10. In FIG. 10, "black triangle" corresponds to comprehensive evaluation "×" shown in Tables 8 and 9; "black square" corresponds to comprehensive evaluation "◎"; and "black circle" corresponds to comprehensive evaluation "☆" or "☆☆." In FIG. 10, Mp corresponds to Pt, and M corresponds to Rh.

TABLE 8

| No. | | Proportion (mass %) Pt | Cu | Rh | Ni | Ir | Evaluation by durability test: Erosion resistance | Tip breakage resistance | Separation resistance | Comprehensive evaluation |
|---|---|---|---|---|---|---|---|---|---|---|
| 100 | Comp. | 80.0 | 0.0 | 0.0 | 20.0 | — | X | ○ | ◎ | X |
| 101 | Ex. | 80.0 | 0.0 | 20.0 | — | — | ☆ | X | X | X |
| 102 | | 80.0 | 0.0 | 0.0 | — | 20.0 | ◎ | X | X | X |
| 103 | | 98.0 | 2.0 | 0.0 | — | — | ◎ | ○ | X | X |
| 104 | | 93.0 | 2.0 | 5.0 | — | — | ☆ | ○ | X | X |
| 105 | | 88.0 | 2.0 | 10.0 | — | — | ☆ | ○ | X | X |
| 106 | | 83.0 | 2.0 | 15.0 | — | — | ☆ | ○ | X | X |
| 107 | | 79.0 | 3.0 | 18.0 | — | — | ☆ | X | X | X |
| 108 | | 75.0 | 5.0 | 20.0 | — | — | ☆ | X | X | X |
| 109 | | 77.0 | 7.0 | 16.0 | — | — | ☆ | X | X | X |
| 110 | | 76.0 | 14.0 | 10.0 | — | — | X | X | ○ | X |
| 111 | | 75.0 | 20.0 | 5.0 | — | — | X | X | ○ | X |
| 112 | | 73.0 | 27.0 | 0.0 | — | — | X | X | ○ | X |

TABLE 9

| No. | | Proportion (mass %) Pt | Cu | Rh | Ni | Ir | Evaluation by durability test: Erosion resistance | Tip breakage resistance | Separation resistance | Comprehensive evaluation |
|---|---|---|---|---|---|---|---|---|---|---|
| 113 | Ex. | 97.0 | 3.0 | 0.0 | — | — | ◎ | ○ | ○ | ◎ |
| 114 | | 92.0 | 3.0 | 5.0 | — | — | ☆ | ○ | ○ | ◎ |
| 115 | | 85.0 | 3.0 | 12.0 | — | — | ☆ | ○ | ○ | ◎ |
| 116 | | 82.0 | 3.0 | 15.0 | — | — | ☆ | ○ | ○ | ◎ |
| 117 | | 80.0 | 3.0 | 17.0 | — | — | ☆ | ○ | ○ | ◎ |
| 118 | | 96.0 | 4.0 | 0.0 | — | — | ◎ | ○ | ○ | ◎ |
| 119 | | 93.0 | 4.0 | 3.0 | — | — | ☆ | ○ | ○ | ◎ |
| 120 | | 88.0 | 4.0 | 8.0 | — | — | ☆ | ○ | ○ | ◎ |
| 121 | | 85.0 | 5.0 | 10.0 | — | — | ☆ | ○ | ○ | ◎ |
| 122 | | 80.0 | 5.0 | 15.0 | — | — | ☆ | ○ | ○ | ◎ |
| 123 | | 83.0 | 7.0 | 10.0 | — | — | ☆ | ○ | ○ | ◎ |
| 124 | | 80.0 | 7.0 | 13.0 | — | — | ☆ | ○ | ○ | ◎ |
| 125 | | 80.0 | 10.0 | 10.0 | — | — | ☆ | ○ | ○ | ◎ |
| 126 | | 78.0 | 12.0 | 10.0 | — | — | ☆ | ○ | ○ | ◎ |
| 127 | | 78.0 | 15.0 | 7.0 | — | — | ☆ | ○ | ○ | ◎ |
| 128 | | 79.0 | 16.0 | 5.0 | — | — | ☆ | ○ | ○ | ◎ |
| 129 | | 79.0 | 18.0 | 3.0 | — | — | ☆ | ○ | ○ | ◎ |
| 130 | | 77.0 | 18.0 | 5.0 | — | — | ☆ | ○ | ○ | ◎ |
| 131 | | 76.0 | 22.0 | 2.0 | — | — | ☆ | ○ | ○ | ◎ |
| 132 | | 77.0 | 23.0 | 0.0 | — | — | ◎ | ○ | ○ | ◎ |
| 133 | | 75.0 | 25.0 | 0.0 | — | — | ◎ | ○ | ○ | ◎ |
| 134 | | 95.0 | 5.0 | 0.0 | — | — | ◎ | ○ | ◎ | ☆ |
| 135 | | 90.0 | 10.0 | 0.0 | — | — | ◎ | ○ | ◎ | ☆ |
| 136 | | 85.0 | 15.0 | 0.0 | — | — | ◎ | ○ | ◎ | ☆ |
| 137 | | 80.0 | 20.0 | 0.0 | — | — | ◎ | ○ | ◎ | ☆ |
| 138 | | 94.5 | 5.0 | 0.5 | — | — | ☆ | ◎ | ◎ | ☆☆ |
| 139 | | 92.0 | 5.0 | 3.0 | — | — | ☆ | ◎ | ◎ | ☆☆ |
| 140 | | 90.0 | 5.0 | 5.0 | — | — | ☆ | ◎ | ◎ | ☆☆ |
| 141 | | 87.0 | 5.0 | 8.0 | — | — | ☆ | ◎ | ◎ | ☆☆ |
| 142 | | 92.5 | 7.0 | 0.5 | — | — | ☆ | ◎ | ◎ | ☆☆ |
| 143 | | 90.0 | 7.0 | 3.0 | — | — | ☆ | ◎ | ◎ | ☆☆ |
| 144 | | 88.0 | 7.0 | 5.0 | — | — | ☆ | ◎ | ◎ | ☆☆ |
| 145 | | 85.0 | 7.0 | 8.0 | — | — | ☆ | ◎ | ◎ | ☆☆ |
| 146 | | 83.0 | 9.0 | 8.0 | — | — | ☆ | ◎ | ◎ | ☆☆ |
| 147 | | 89.5 | 10.0 | 0.5 | — | — | ☆ | ◎ | ◎ | ☆☆ |
| 148 | | 87.0 | 10.0 | 3.0 | — | — | ☆ | ◎ | ◎ | ☆☆ |
| 149 | | 85.0 | 10.0 | 5.0 | — | — | ☆ | ◎ | ◎ | ☆☆ |
| 150 | | 82.0 | 10.0 | 8.0 | — | — | ☆ | ◎ | ◎ | ☆☆ |
| 151 | | 87.5 | 12.0 | 0.5 | — | — | ☆ | ◎ | ◎ | ☆☆ |
| 152 | | 85.0 | 12.0 | 3.0 | — | — | ☆ | ◎ | ◎ | ☆☆ |
| 153 | | 80.0 | 12.0 | 8.0 | — | — | ☆ | ◎ | ◎ | ☆☆ |
| 154 | | 80.0 | 14.0 | 6.0 | — | — | ☆ | ◎ | ◎ | ☆☆ |
| 155 | | 84.5 | 15.0 | 0.5 | — | — | ☆ | ◎ | ◎ | ☆☆ |
| 156 | | 82.0 | 15.0 | 3.0 | — | — | ☆ | ◎ | ◎ | ☆☆ |
| 157 | | 80.0 | 15.0 | 5.0 | — | — | ☆ | ◎ | ◎ | ☆☆ |

TABLE 9-continued

| No. | Pt | Cu | Rh | Ni | Ir | Erosion resistance | Tip breakage resistance | Separation resistance | Comprehensive evaluation |
|---|---|---|---|---|---|---|---|---|---|
| | Proportion (mass %) | | | | | Evaluation by durability test | | | |
| 158 | 80.0 | 17.0 | 3.0 | — | — | ☆ | ◎ | ◎ | ☆☆ |
| 159 | 80.0 | 18.0 | 2.0 | — | — | ☆ | ◎ | ◎ | ☆☆ |
| 160 | 79.5 | 20.0 | 0.5 | — | — | ☆ | ◎ | ◎ | ☆☆ |

TABLE 10

| No. | | Pt | Cu | Rh | Ir | Ru | Erosion resistance | Tip breakage resistance | Separation resistance | Comprehensive evaluation |
|---|---|---|---|---|---|---|---|---|---|---|
| | | Proportion (mass %) | | | | | Evaluation by durability test | | | |
| 114 | Ex. | 92.0 | 3.0 | 5.0 | | | ☆ | ○ | ○ | ◎ |
| 161 | | 92.0 | 3.0 | | 5.0 | | ◎ | ○ | ○ | ◎ |
| 162 | | 90.0 | 5.0 | 2.0 | 3.0 | | ◎ | ○ | ○ | ◎ |
| 140 | | 90.0 | 5.0 | 5.0 | | | ☆ | ◎ | ◎ | ☆☆ |
| 163 | | 90.0 | 5.0 | | 2.0 | 3.0 | ◎ | ◎ | ◎ | ☆☆ |

TABLE 11

| No. | | Pt | Cu | Rh | Pd | Erosion resistance | Tip breakage resistance | Separation resistance | Comprehensive evaluation |
|---|---|---|---|---|---|---|---|---|---|
| | | Proportion (mass %) | | | | Evaluation by durability test | | | |
| 121 | Ex. | 85.0 | 5.0 | 10.0 | | ☆ | ○ | ○ | ◎ |
| 164 | | 65.0 | 5.0 | 10.0 | 20.0 | ☆ | ○ | ◎ | ☆ |

TABLE 12

| No. | | Pt | Cu | Rh | Ni | Co | Ti | La | Erosion resistance | Tip breakage resistance | Separation resistance | Comprehensive evaluation |
|---|---|---|---|---|---|---|---|---|---|---|---|---|
| | | Proportion (mass %) | | | | | | | Evaluation by durability test | | | |
| 127 | Ex. | 78.0 | 15.0 | 7.0 | | | | | ☆ | ○ | ○ | ◎ |
| 165 | | 73.0 | 15.0 | 7.0 | | 5.0 | | | ☆ | ○ | ◎ | ☆ |
| 166 | Comp. Ex. | 72.0 | 15.0 | 7.0 | | 6.0 | | | ◎ | X | ○ | X |
| 114 | Ex. | 92.0 | 3.0 | 5.0 | | | | | ☆ | ○ | ○ | ◎ |
| 167 | | 90.5 | 3.0 | 5.0 | | | 1.5 | | ☆ | ◎ | ○ | ☆ |
| 168 | | 90.0 | 3.0 | 5.0 | | | 2.0 | | ◎ | ○ | ○ | ◎ |
| 120 | | 88.0 | 4.0 | 8.0 | | | | | ☆ | ○ | ○ | ◎ |
| 169 | | 83.0 | 4.0 | 8.0 | 3.5 | | | 1.5 | ☆ | ◎ | ◎ | ☆☆ |
| 170 | Comp. Ex. | 82.5 | 4.0 | 8.0 | 3.5 | | | 2.0 | X | ○ | ○ | X |

TABLE 13

| No. | | S ($mm^2$) | H (mm) | Pt—18Cu—5Rh Erosion resistance | Pt—18Cu—5Rh Tip breakage resistance | Pt—20Cu Erosion resistance | Pt—20Cu Tip breakage resistance | Pt—20Cu—0.5Rh Erosion resistance | Pt—20Cu—0.5Rh Tip breakage resistance |
|---|---|---|---|---|---|---|---|---|---|
| | | Proportion (mass %) | | Evaluation by durability test | | | | | |
| 180 | Ex. | 0.2 | 0.15 | ☆ | ○ | ◎ | ○ | ☆ | ◎ |
| 181 | | 0.2 | 1.20 | ☆ | ○ | ◎ | ○ | ☆ | ◎ |
| 182 | Comp. Ex. | 0.2 | 1.40 | ◎ | X | ○ | ○ | ☆ | ○ |
| 183 | Ex. | 0.8 | 0.20 | ☆ | ○ | ◎ | ○ | ☆ | ◎ |
| 184 | Comp. Ex. | 0.8 | 1.50 | ◎ | X | ○ | ○ | ☆ | ○ |
| 185 | Ex. | 1.4 | 1.30 | ☆ | ○ | ◎ | ○ | ☆ | ◎ |

TABLE 13-continued

| No. | | Proportion (mass %) S ($mm^2$) | H (mm) | Pt—18Cu—5Rh Erosion resistance | Pt—18Cu—5Rh Tip breakage resistance | Pt—20Cu Erosion resistance | Pt—20Cu Tip breakage resistance | Pt—20Cu—0.5Rh Erosion resistance | Pt—20Cu—0.5Rh Tip breakage resistance |
|---|---|---|---|---|---|---|---|---|---|
| | | | | Evaluation by durability test | | | | | |
| 186 | Comp. Ex. | 2.1 | 1.70 | ◎ | X | ○ | ○ | ☆ | ○ |
| 187 | Ex. | 2.8 | 0.20 | ☆ | ○ | ◎ | ○ | ☆ | ◎ |
| 188 | | 2.8 | 1.00 | ☆ | ○ | ◎ | ○ | ☆ | ◎ |
| 189 | | 2.8 | 1.50 | ☆ | ○ | ◎ | ○ | ☆ | ◎ |
| 190 | Comp. Ex. | 2.8 | 1.80 | ◎ | X | ○ | ○ | ☆ | ○ |
| 191 | Ex. | 4.0 | 1.60 | ☆ | ○ | ◎ | ○ | ☆ | ◎ |
| 192 | Comp. Ex. | 5.0 | 2.10 | ◎ | X | ○ | ○ | ☆ | ○ |
| 193 | Ex. | 5.0 | 0.20 | ☆ | ○ | ◎ | ○ | ☆ | ◎ |
| 194 | | 5.0 | 1.00 | ☆ | ○ | ◎ | ○ | ☆ | ◎ |
| 195 | | 5.0 | 1.80 | ☆ | ○ | ◎ | ○ | ☆ | ◎ |

TABLE 14

| No. | | Protrusion (mass %) S ($mm^2$) | H (mm) | Pt—18Cu—5Rh Welding method: Resistance + Laser, Shape of ground electrode tip: Circular columnar shape I, Evaluation by durability test: Erosion resistance | Tip breakage resistance | Resistance, Circular Columnar shape II | Tip breakage resistance | Laser, Protruded shape | Tip breakage resistance | Resistance, Rectangular columnar shape | Tip breakage resistance | Laser, Hemispherical shape | Tip breakage resistance | Comprehensive evaluation |
|---|---|---|---|---|---|---|---|---|---|---|---|---|---|---|
| 196 | Ex. | 0.2 | 1.20 | ☆ | ○ | ☆ | ○ | ☆ | ○ | ◎ | ○ | ◎ | ○ | ○ |
| 197 | Comp. Ex. | 0.2 | 1.40 | ◎ | X | ◎ | X | ◎ | X | ○ | X | ○ | X | X |

TABLE 15

| No. | | Proportion (mass %) S ($mm^2$) | Pt—3Cu—17Rh | Pt—5Cu | Pt—5Cu—8Rh |
|---|---|---|---|---|---|
| | | | Evaluation by durability test Separation resistance | | |
| 198 | Ex. | 0.3 | ○ | ◎ | ◎ |
| 199 | | 0.9 | ○ | ◎ | ◎ |
| 200 | | 2.5 | ○ | ◎ | ◎ |
| 201 | | 5.0 | ○ | ◎ | ◎ |
| 202 | Comp. Ex. | 5.3 | X | ○ | ○ |

TABLE 16

| No. | | Proportion (mass %) L (mm) | h (mm) | Pt—3Cu—17Rh | Pt—5Cu | Pt—5Cu—8Rh |
|---|---|---|---|---|---|---|
| | | | | Evaluation by durability test Separation resistance | | |
| 203 | Ex. | 0.05 | 0 | ○ | ◎ | ◎ |
| 204 | | 0.03 | 0 | ○ | ◎ | ◎ |
| 205 | Comp. Ex. | 0 | 0 | X | ○ | ○ |
| 206 | Ex. | 0 | 0.2 | ○ | ◎ | ◎ |
| 207 | | 0 | 0.1 | ○ | ◎ | ◎ |
| 208 | Comp. Ex. | 0 | 0 | X | ○ | ○ |

TABLE 17

| | | | | Pt—3Cu—17Rh Welding method | | | | |
|---|---|---|---|---|---|---|---|---|
| | | | | Resistance + Laser | Resistance | Laser | Resistance | Resistance + Laser |
| | | | | Shape of ground electrode tip | | | | |
| | Proportion (mass %) | | | Circular columnar shape I | Circular columnar shape II | Protruded shape | Rectangular columnar shape | Hemispherical shape |
| No. | S ($mm^2$) | L (mm) | h (mm) | Evaluation by durability test Separation resistance | | | | |
| 209 Ex. | 5.0 | 0 | 0.1 | ○ | ○ | ○ | ○ | ○ |
| 210 Comp. Ex. | 5.0 | 0 | 0 | X | X | X | X | X |
| 211 Ex. | 5.0 | 0.03 | 0 | ○ | ○ | ○ | ○ | ○ |
| 212 Comp. Ex. | 5.2 | 0.03 | 0 | X | X | X | X | X |

TABLE 18

| | Proportion (mass %) | | | Evaluation | |
|---|---|---|---|---|---|
| No. | Pt | Cu | Rh | Hardness | Deformation resistance |
| 213 Comp. Ex. | 80.0 | 0 | 20.0 | 210 | X |
| 214 Ex. | 92.0 | 3.0 | 5.0 | 120 | ○ |
| 215 | 92.0 | 3.0 | 5.0 | 145 | ◎ |
| 216 | 88.0 | 4.0 | 8.0 | 180 | ◎ |
| 217 | 88.0 | 4.0 | 8.0 | 200 | ☆ |

TABLE 19

| | Proportion (mass %) | | | | Resistance | Evaluation by durability test |
|---|---|---|---|---|---|---|
| No. | Pt | Cu | Rh | Ni | (kΩ) | Erosion resistance |
| 100 Comp. | 80.0 | 0 | 0 | 20.0 | 5 | X |
| 218 Ex. | 80.0 | 0 | 0 | 20.0 | 10 | X |
| 219 | 80.0 | 0 | 0 | 20.0 | 15 | ○ |
| 130 Ex. | 77.0 | 18.0 | 5.0 | 0 | 5 | ☆ |
| 220 | 77.0 | 18.0 | 5.0 | 0 | 10 | ☆ |
| 221 | 77.0 | 18.0 | 5.0 | 0 | 15 | ☆ |

As shown in Tables 9 to 19, a spark plug including a noble metal tip falling within the scope of the second invention exhibited excellent erosion resistance, separation resistance, and tip breakage resistance.

In contrast, in the case of a spark plug including a noble metal tip falling outside the scope of the present invention, as shown in Tables 8 and 12 to 19, at least one of erosion resistance, separation resistance, and tip breakage resistance was impaired.

As shown in Table 10, noble metal tips containing any of Rh, Ir, and Ru exhibited similar performances. As shown in Table 11, the spark plug (No. 121) including a noble metal tip containing Pt, Cu, and Rh exhibited a performance similar to that of the spark plug (No. 164) including a noble metal tip containing Pt, Cu, Rh, and Pd. As shown in Table 12, a spark plug including a noble metal tip containing at least one of Ni, Co, Ti, and La in a total amount of 5 mass % or less exhibited further excellent erosion resistance, separation resistance, and tip breakage resistance, as compared with a spark plug including a noble metal tip not containing such an element, or a spark plug including a noble metal tip containing such an element in a total amount of more than 5 mass %.

Figure 13:
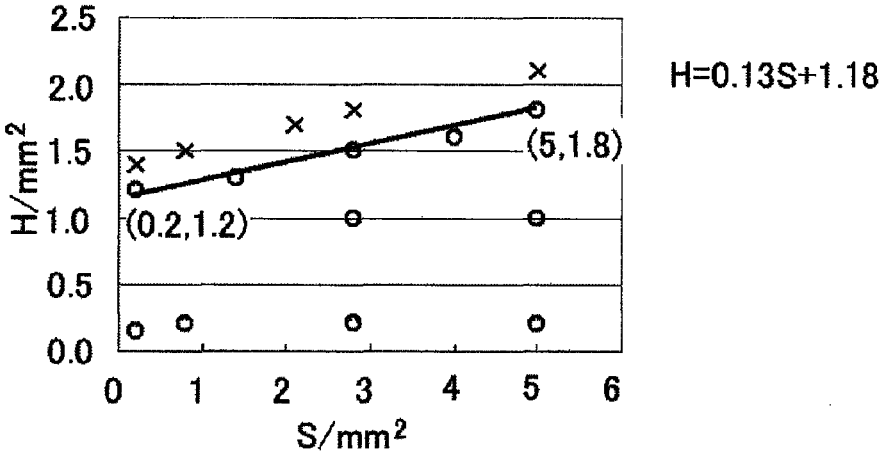
FIG. 13 shows durability evaluation test results with varying tip protrusion height H and welding area S.

FIG. 13 shows the evaluation results of a spark plug including a noble metal tip having an elemental composition of Pt-18Cu-5Rh (see Table 13), wherein the vertical axis corresponds to tip protrusion height H (mm) and the horizontal axis corresponds to welding area S ($mm^2$). As shown in FIG. 13, a spark plug including a ground electrode tip falling within the scope of the second invention exhibited favorable evaluation results in terms of erosion resistance and tip breakage resistance, as compared with the spark plug (No. 182, 186, 190, or 192) including a ground electrode tip in which H is greater than a level defined by the line (H=0.13S+1.18) formed by connecting a point (0.2, 1.2) and a point (5, 1.8). As shown in Table 14, a spark plug including a ground electrode tip having a tip protrusion height H smaller than a level defined by the aforementioned line exhibited favorable comprehensive evaluation, regardless of the shape of the ground electrode tip.

As shown in Table 15, a spark plug including a ground electrode tip having a welding area S of 5.0 or less exhibited favorable evaluation in terms of separation resistance. As shown in Table 16, a spark plug including a ground electrode tip having h of 0.1 (mm) or more or L of 0.03 (mm) or more exhibited excellent evaluation in terms of separation resistance. As shown in Table 17, a spark plug including a ground electrode tip having a welding area S ($mm^2$) of 5.0 or less and h of 0.1 (mm) or more or L of 0.03 (mm) or more exhibited favorable evaluation in terms of separation resistance, regardless of the shape of the ground electrode tip.

As shown in Table 18, a spark plug including a noble metal tip falling within the scope of the present invention exhibited further excellent deformation resistance when the hardness of the noble metal tip was 140 Hv or more (particularly 200 Hv or more). As shown in Table 19, a spark plug including a noble metal tip falling within the scope of the present invention exhibited excellent erosion resistance even when the resistance of the resistor was 10 kΩ or less.

| Description of Reference Numerals | |
|---|---|
| 1, 101, 102: | spark plug |
| 2: | metallic shell |
| 3: | insulator |
| 4: | center electrode |
| 5: | resistor |
| 6: | terminal shell |
| 7: | ground electrode |
| 8: | ground electrode tip |
| 9: | center electrode tip |
| 10: | threaded portion |
| 11: | talc |
| 12: | packing |
| 13: | outer member |
| 14: | inner member |
| 15: | welded portion |

-continued

| Description of Reference Numerals | |
|---|---|
| 16: | bonding surface |
| 17: | boundary line |
| 18: | base |
| 20: | axial hole |
| 21: | welded portion of center electrode tip |
| G: | spark discharge gap |

The invention claimed is:

1. A spark plug comprising:

a center electrode;

a ground electrode provided so as to form a gap between the ground electrode and the center electrode; and a noble metal tip provided on at least one of the center electrode and the ground electrode, wherein, the noble metal tip contains Mp (Mp is an element group consisting of Pt or Pt and Pd, and the amount of Pd is 20 mass % or less with respect to the mass of the noble metal tip), Cu, and M (M is at least one element selected from the element group consisting of Rh, Ir, Ru, Re, and W) in a total amount of 95 mass % or more; and the proportions by mass of Mp, Cu, and M (Mp, Cu, M) in a Mp-Cu-M ternary composition diagram fall within a region defined by a line connecting point D (95, 5, 0), point E (94.5, 5, 0.5), point F (87, 5, 8), point G (80, 12, 8), point H (79.5, 20, 0.5), point I (80, 20, 0), and point D (95, 5, 0) in this order (the region including the line).

2. The spark plug according to claim 1, wherein, the noble metal tip provides the proportions by mass (Mp, Cu, M) in the Mp-Cu-M ternary composition diagram that fall within a region defined by a line connecting point E (94.5, 5, 0.5), point F (87, 5, 8), point G (80, 12, 8), point H (79.5, 20, 0.5), and point E (94.5, 5, 0.5) in this order (the region including the line).

3. A spark plug comprising:

an insulator having an axial hole;

a center electrode provided in the axial hole; a ground electrode provided so as to form a gap between the ground electrode and the center electrode; and a noble metal tip provided on at least one of the center electrode and the ground electrode, wherein, the noble metal tip contains Mp (Mp is an element group consisting of Pt or Pt and Pd, and the amount of Pd is 20 mass % or less with respect to the mass of the noble metal tip), Cu, and M (M is at least one element selected from the element group consisting of Rh, Ir, Ru, Re, and W) in a total amount of 95 mass % or more;

the proportions by mass of Mp, Cu, and M (Mp, Cu, M) in a Mp-Cu-M ternary composition diagram fall within a region defined by a line connecting point A (97, 3, 0), point B (80, 3, 17), point C (75, 25, 0), and point A (97, 3, 0) in this order (the region including the line); and welding area S ($mm^2$), tip protrusion height H (mm), covering length L (mm), and tip-welded portion distance h (mm) satisfy the following relations: (a) $H \leq 0.13S+1.18$, (b) $S \leq 5$, and (c) $0.1 \leq h$ or $0.03 \leq L$, wherein welding area S is defined as being the area of a region in which, when the noble metal tip is provided on an end surface or a peripheral side surface of the center electrode and/or the ground electrode, as viewed in a direction X—which is a direction perpendicular to a bonding surface of a mounting metallic body (the body corresponding to the center electrode, the ground electrode, or a base provided between each of these electrodes and the noble metal tip) to which the noble metal tip is bonded via a welded portion formed through fusion between the noble metal tip and the mounting metallic body, a projection region formed by projection of the mounting metallic body on a surface perpendicular to the direction X overlaps a projection region formed by projection of the noble metal tip on a surface perpendicular to the direction X (when the noble metal tip is bonded to the mounting metallic body via a plurality of surfaces of the mounting metallic body, welding area S is defined as being the total area of regions in which, as viewed in directions Y—which are perpendicular to the surfaces, the surfaces overlap one another);

tip protrusion height H is defined as being the distance between the bonding surface of the mounting metallic body and the end surface of the noble metal tip most distal from the bonding surface, the distance being determined in a direction in which the noble metal tip faces a facing metallic protrusion (the protrusion corresponding to the noble metal tip, a portion protruded from the front end of the center electrode, or portion protruded from the distal end of the ground electrode) (when the welded portion is provided between the noble metal tip and the mounting metallic body so as to cover the entire top surface of the mounting metallic body, tip protrusion height H is defined as being the distance between a point corresponding to ½ the thickness of the thinnest portion of the welded portion in a direction of an axis PX of the noble metal tip, and the surface of the noble metal tip most distal from the point in the direction of the axis PX); and covering length L and tip-welded portion distance h are defined as follows: in the case where the axial hole extends in a direction of an axis AX of the center electrode, (1) when the noble metal tip and the facing metallic protrusion are arranged so as to face each other in the direction of the axis AX, and the noble metal tip does not project from the mounting metallic body in a direction perpendicular to the axis AX, covering length L is defined as being the minimum distance, as viewed in the direction of the axis AX, between a straight line group which includes a point k1 on a peripheral side surface corresponding to the maximum diameter of the noble metal tip and which is parallel to the axis AX, and a straight line group which includes a point k2 on a peripheral side surface corresponding to the maximum diameter of the facing metallic protrusion, facing the noble metal tip, and which is parallel to the axis AX; and tip-welded portion distance h is defined as being the distance in the direction of the axis AX as measured, on a surface of the noble metal tip which includes the point k1 and is parallel to the axis AX, from the end of the noble metal tip to the boundary between the tip and the welded portion; or (2) when the noble metal tip projects from the ground electrode in a direction perpendicular to the axis AX, and the front end surface of the facing metallic protrusion faces the noble metal tip in the direction of the axis AX, covering length L is defined as being the minimum distance, as viewed in the direction of the axis AX, between a point k3 on a projection region formed by projection of the front end surface of the facing metallic protrusion on a virtual surface perpendicular to the direction of the axis AX, and an intersection point k4 provided by intersection of the contour of a projection region formed by projection of the ground electrode on the virtual surface with the contour of a projection region formed by projection of the noble metal tip on the virtual surface; and (i) in the noble metal tip, tip-welded portion distance h is defined as being the distance as measured, on a surface of the noble metal tip which includes the point k4 and is parallel to the axis AX, from the end of the noble metal tip to the boundary between the tip and the welded portion; or (ii) when the facing metallic protrusion is the noble metal tip provided on the center electrode, tip-welded portion distance h is defined as being the distance in the direction of the axis AX as measured, on a surface of the noble metal tip which includes the point k3 and is parallel to the axis AX, from the end of the noble metal tip to the boundary between the tip and the welded portion.

4. The spark plug according to claim 1, wherein Mp is Pt and Pd.

5. The spark plug according to claim 1, wherein, the noble metal tip contains at least one element selected from an element group A consisting of Ni, Co, Fe, and Mn, and/or an element group B consisting of Ti, Hf, Y, and rare earth elements;

the total mass of the element group A is 5 mass % or less;

the total mass of the element group B is 1.5 mass % or less; and the total mass of the element group A and the element group B is 5 mass % or less.

6. The spark plug according to claim 1, wherein M is Rh.

7. The spark plug according to claim 1 comprising:

an insulator having an axial hole;

the center electrode being provided in the axial hole;

the ground electrode being provided so as to form a gap between the ground electrode and the center electrode; and the noble metal tip being provided on at least one of the center electrode and the ground electrode, wherein welding area S ($mm^2$), tip protrusion height H (mm), covering length L (mm), and tip-welded portion distance h (mm) satisfy the following relations: (a) $H \leq 0.13S+1.18$, (b) $S \leq 5$, and (c) $0.1 \leq h$ or $0.03 \leq L$, wherein welding area S is defined as being the area of a region in which, when the noble metal tip is provided on an end surface or a peripheral side surface of the center electrode and/or the ground electrode, as viewed in a direction X—which is a direction perpendicular to a bonding surface of a mounting metallic body (the body corresponding to the center electrode, the ground electrode, or a base provided between each of these electrodes and the noble metal tip) to which the noble metal tip is bonded via a welded portion formed through fusion between the noble metal tip and the mounting metallic body, a projection region formed by projection of the mounting metallic body on a surface perpendicular to the direction X overlaps a projection region formed by projection of the noble metal tip on a surface perpendicular to the direction X (when the noble metal tip is bonded to the mounting metallic body via a plurality of surfaces of the mounting metallic body, welding area S is defined as being the total area of regions in which, as viewed in directions Y—which are perpendicular to the surfaces, the surfaces overlap one another);

tip protrusion height H is defined as being the distance between the bonding surface of the mounting metallic body and the end surface of the noble metal tip most distal from the bonding surface, the distance being determined in a direction in which the noble metal tip faces a facing metallic protrusion (the protrusion corresponding to the noble metal tip, a portion protruded from the front end of the center electrode, or portion protruded from the distal end of the ground electrode) (when the welded portion is provided between the noble metal tip and the mounting metallic body so as to cover the entire top surface of the mounting metallic body, tip protrusion height H is defined as being the distance between a point corresponding to ½ the thickness of the thinnest portion of the welded portion in a direction of an axis PX of the noble metal tip, and the surface of the noble metal tip most distal from the point in the direction of the axis PX); and covering length L and tip-welded portion distance h are defined as follows: in the case where the axial hole extends in a direction of an axis AX of the center electrode, (1) when the noble metal tip and the facing metallic protrusion are arranged so as to face each other in the direction of the axis AX, and the noble metal tip does not project from the mounting metallic body in a direction perpendicular to the axis AX, covering length L is defined as being the minimum distance, as viewed in the direction of the axis AX, between a straight line group which includes a point k1 on a peripheral side surface corresponding to the maximum diameter of the noble metal tip and which is parallel to the axis AX, and a straight line group which includes a point k2 on a peripheral side surface corresponding to the maximum diameter of the facing metallic protrusion, facing the noble metal tip, and which is parallel to the axis AX; and tip-welded portion distance h is defined as being the distance in the direction of the axis AX as measured, on a surface of the noble metal tip which includes the point k1 and is parallel to the axis AX, from the end of the noble metal tip to the boundary between the tip and the welded portion; or (2) when the noble metal tip projects from the ground electrode in a direction perpendicular to the axis AX, and the front end surface of the facing metallic protrusion faces the noble metal tip in the direction of the axis AX, covering length L is defined as being the minimum distance, as viewed in the direction of the axis AX, between a point k3 on a projection region formed by projection of the front end surface of the facing metallic protrusion on a virtual surface perpendicular to the direction of the axis AX, and an intersection point k4 provided by intersection of the contour of a projection region formed by projection of the ground electrode on the virtual surface with the contour of a projection region formed by projection of the noble metal tip on the virtual surface; and (i) in the noble metal tip, tip-welded portion distance h is defined as being the distance as measured, on a surface of the noble metal tip which includes the point k4 and is parallel to the axis AX, from the end of the noble metal tip to the boundary between the tip and the welded portion; or (ii) when the facing metallic protrusion is the noble metal tip provided on the center electrode, tip-welded portion distance h is defined as being the distance in the direction of the axis AX as measured, on a surface of the noble metal tip which includes the point k3 and is parallel to the axis AX, from the end of the noble metal tip to the boundary between the tip and the welded portion.

8. The spark plug according to claim 1, wherein the noble metal tip has a hardness of 140 Hv or more.

9. The spark plug according to claim 1, wherein the noble metal tip has a hardness of 200 Hv or more.

10. The spark plug according to claim 7, wherein, the center electrode is fixed in the axial hole of the insulator so as to be exposed through one end of the axial hole;

a terminal shell is fixed in the axial hole so as to be exposed through the other end of the axial hole;

a resistor is provided between the center electrode and the terminal shell in the axial hole; and the resistor has a resistance of 10 kΩ or less.

11. The spark plug according to claim 1, wherein the noble metal tip is provided only on the ground electrode.

* * * * *